US011441354B2

(12) United States Patent
Hooiveld

(10) Patent No.: US 11,441,354 B2
(45) Date of Patent: Sep. 13, 2022

(54) TELESCOPIC LADDER ASSEMBLY

(71) Applicant: Lampe Holding B.V., Bennebroek (NL)

(72) Inventor: Marcel Cornelis Hooiveld, Venhuizen (NL)

(73) Assignee: Lampe Holding B.V., Bennebroek (NL)

( * ) Notice: Subject to any disclaimer, the term of this patent is extended or adjusted under 35 U.S.C. 154(b) by 543 days.

(21) Appl. No.: 16/349,680

(22) PCT Filed: Nov. 14, 2017

(86) PCT No.: PCT/NL2017/050733

§ 371 (c)(1),
(2) Date: May 14, 2019

(87) PCT Pub. No.: WO2018/088906

PCT Pub. Date: May 17, 2018

(65) Prior Publication Data

US 2019/0360269 A1 Nov. 28, 2019

(30) Foreign Application Priority Data

Nov. 14, 2016 (NL) ..... 2017780
Sep. 22, 2017 (NL) ..... 2019611

(51) Int. Cl.
*E06C 1/12* (2006.01)
*E06C 7/08* (2006.01)
(Continued)

(52) U.S. Cl.
CPC ..... *E06C 1/125* (2013.01); *E06C 7/082* (2013.01); *E06C 7/50* (2013.01); *E06C 1/18* (2013.01); *E06C 1/22* (2013.01); *E06C 1/383* (2013.01)

(58) Field of Classification Search
CPC ... E06C 1/18; E06C 1/22; E06C 1/125; E06C 1/383; E06C 7/082; E06C 7/50
See application file for complete search history.

(56) References Cited

U.S. PATENT DOCUMENTS 5,743,355 A 4/1998 McDonnell et al.
7,316,293 B2 * 1/2008 Yao ..... E06C 1/125 182/195
9,845,640 B2 * 12/2017 Chen ..... E06C 7/02

FOREIGN PATENT DOCUMENTS

CN 2610056 Y 4/2004
CN 201170058 Y * 12/2008 ..... E06C 1/125
(Continued)

*Primary Examiner* — Colleen M Chavchavadze
(74) *Attorney, Agent, or Firm* — Hoffmann & Baron, LLP

(57) ABSTRACT

A telescopically extendable and collapsible ladder assembly includes multiple collapsible ladder sections provided with an air damper at the bottom end of tubular stile members. The air dampers provide retardation of gravity induced velocity of the collapsible ladder sections upon collapse of the ladder sections. Multiple air dampers include a throttle valve securing device, for cooperating with a throttle valve of the air damper when the collapsible ladder section is in the collapsed position, to secure the throttle valve in its throttle position and/or an obturator device. The obturator device includes a first obturator member and a second obturator member where the first obturator member and the second obturator member are configured to, when the collapsible ladder section is in the collapsed position, in combination provide additional throttling.

20 Claims, 10 Drawing Sheets

(51) Int. Cl.

| | |
|---|---|
| ***E06C 7/50*** | (2006.01) |
| *E06C 1/18* | (2006.01) |
| *E06C 1/22* | (2006.01) |
| *E06C 1/383* | (2006.01) |

(56) References Cited

FOREIGN PATENT DOCUMENTS

| | | | | | | |
|---|---|---|---|---|---|---|
| CN | 201212352 | Y | | 3/2009 | | |
| CN | 201991430 | U | * | 9/2011 | ..... | E06C 1/125 |
| CN | 205840753 | U | * | 12/2016 | ..... | E06C 1/125 |
| DE | 202006005657 | U1 | * | 8/2006 | ..... | E06C 1/125 |
| EP | 2770155 | A1 | | 8/2014 | | |
| WO | WO-2008064532 | A1 | * | 6/2008 | ..... | E06C 7/06 |
| WO | WO-2017088891 | A | * | 6/2017 | ..... | E06C 7/08 |

* cited by examiner

TELESCOPIC LADDER ASSEMBLY

CROSS-REFERENCE TO RELATED APPLICATIONS

This application is the National Stage of International Application No. PCT/NL2017/050733, filed Nov. 14, 2017, which claims the benefit of Netherlands Application Nos. NL 2017780, filed Nov. 14, 2016, and NL 2019611, filed Sep. 22, 2017, the contents of all of which are incorporated by reference herein.

FIELD OF THE INVENTION

The present invention relates to a telescopically extendable and collapsible ladder assembly having a bottom ladder section, a top ladder section, and one or more intermediate ladder sections. In particular the invention relates to a collapsible ladder assembly provided with air dampers that provide retardation of a gravity induced velocity of the collapsible ladder sections during collapse of the ladder assembly.

BACKGROUND OF THE INVENTION

A telescopically extendable and collapsible ladder assembly typically comprises multiple ladder sections, wherein each of the ladder sections comprises two tubular stile members, each tubular stile member having a bottom end and a top end and each tubular stile member defining an inner space, which tubular stile members are arranged parallel to each other and are interconnected at the top end by a ladder rung to form an essentially U-shaped ladder section, wherein preferably the tubular stile members of the bottom ladder section are furthermore connected by a bottom ladder rung.

The top ladder section and the one or more intermediate ladder sections are collapsible ladder sections, each collapsible ladder section having the bottom end of the tubular stile members telescopically inserted into the top end of the tubular stile members of an adjacent ladder section, the adjacent ladder section being the bottom ladder section or an intermediate ladder section, such that each collapsible ladder section can be moved relative to the adjacent ladder section between;

- a collapsed position, in which the bottom end of the tubular stile members of the collapsible ladder section are located near the bottom end of the tubular stile members of the adjacent ladder section; and
- an extended position, in which the bottom end of the tubular stile members of the collapsible ladder section are located away from the bottom end of the tubular stile members of the adjacent ladder section.

The ladder assembly comprises latch mechanisms for locking the telescopically inserted tubular stile members of the collapsible ladder sections relative to the adjacent ladder sections when the collapsible ladder section are in the extended position, the latch mechanisms being associated with actuators for unlocking the tubular stile members in order to allow for collapsing of the ladder assembly, i.e. moving al collapsible ladder sections into the collapsed position.

These ladder assemblies have become quite popular as portable ladders, such as a straight telescopic ladder, a stepladder, or another "ladder product" such as a combination ladder, a work platform with ladder like telescopic legs, etc.

For safety reasons it is known to use air dampers to reduce the sliding speed of the ladder sections when the ladder is collapsed. To enable a controlled collapse of these ladder assemblies, the collapsible ladder sections are provided with air dampers, which air dampers provide retardation of gravity induced velocity of the collapsible ladder section.

In such ladder assemblies the collapsible ladder sections are each provided with an air damper at the bottom end of one of at least one of the tubular stile members, which air dampers provide retardation of gravity induced velocity of the collapsible ladder sections upon collapse of the ladder sections on the basis of throttling an airflow flowing out of the inner space of the tubular stile member of the adjacent ladder section into the inner space of the tubular stile member of the collapsible ladder section being inserted into the inner space of the tubular stile member of the adjacent ladder section.

Thus a user is allowed sufficient time to react to the collapsing ladder sections and, if needed can timely remove his/her hand.

Such ladder assemblies are for example known from U.S. Pat. No. 5,743,355 and EP2770155.

In U.S. Pat. No. 5,743,355 it is proposed to provide air dampers at the bottom end of the tubular stile members, which air dampers provide retardation on the basis that, upon collapse of the ladder, air has to flow through an orifice in the air damper.

In EP2770155 it is proposed to provide air dampers comprising a sealing ring throttling the flow of air flowing through the annular opening between the telescopically connected tubular stile members of the collapsing ladder sections. These air dampers are active during collapse of the ladder, but enable a less restricted air flow when the ladder is extended.

SUMMARY OF THE INVENTION

The invention is in particular beneficial for telescopically extendable and collapsible ladder assemblies wherein each of the air dampers comprises:

an air damper body defining a throttle opening, which throttle opening provides an air path that enables air to flow out of the tubular stile member of the adjacent ladder section into the tubular stile member of the collapsible ladder section on which the air damper is mounted and vice versa;

a throttle valve, which throttle valve is located at the throttle opening, at a side of the air damper that faces the adjacent ladder section, and which throttle valve is movable relative to the throttle opening between:

- a release position, in which release position the throttle valve is located away from the throttle opening to allow for a maximum air flow to flow through the throttle opening out of the stile member on which the air damper is mounted, and thus, upon extending the ladder section, to enable aerating of the inner space of the adjacent ladder section out of which the collapsing ladder section is moved; and
- a throttle position, in which the throttle valve is located adjacent or in the throttle opening to throttle, preferably block, an air flow flowing through the throttle opening into the stile member of the collapsible ladder section on which the air damper is mounted, and thus, upon collapsing of the collapsible ladder section, enabling a pressure to build up in the inner space of the stile member of the adjacent ladder section into which the collapsible ladder section is being inserted.

During the collapse of the ladder assembly, the throttle valve of the air dampers is moved into the throttle position to throttle an air flow flowing into the stile member of the collapsing ladder section, and to thus retard the gravity induced collapsing speed.

During extension of the ladder assembly, the throttle valve of the air dampers is moved into the release position to allow for a maximum air flow to flow out of the collapsing ladder section, and to thus facilitate moving the ladder sections into the extended position.

It is however submitted that even when these types of air dampers are used, many factors influence the sliding behaviour of the ladder sections. For example the difference in weight of the collapsing ladder sections, the volume of air displaced by the collapsing ladder section, the amount of leakage of air via openings in and between tubular stile members of the ladder sections, etc. Therefore, it is difficult to control the sliding behaviour, in particular the time required for a collapsible ladder section to move from the extended position into the collapsed position. In practice the time required for the ladder sections to move from the extended position to the collapsed position often differ for each ladder section.

It is an object of the invention to provide an improved collapsible ladder assembly, more in particular to obviate one or more of the problems described hereinabove.

The invention is in particular beneficial for telescopically extendable and collapsible ladder assemblies comprising an air damper as described above. It is however submitted that the invention can also be used with telescopically extendable and collapsible ladder assemblies having other types of air dampers, for example an air damper comprising a throttle opening without a throttle valve.

According to the present invention, this object is achieved by providing a ladder assembly of the initially indicated kind having for multiple, preferably for each, of the air dampers a throttle valve securing device and/or an obturator device to provide throttling or even blockage of an air flow out of the stile members on which the air valve is mounted, while the ladder section is in the collapsed position.

A ladder assembly according to the invention comprises for multiple, preferably for each of the air dampers:

a throttle valve securing device, located at the bottom end of the adjacent ladder section, for cooperating with, preferably engage, the throttle valve of the air damper when the collapsible ladder section is in the collapsed position, to secure the throttle valve in its throttle position and to thus enable the throttle valve to throttle, preferably block, an air flow flowing through the throttle opening out of the tubular stile member on which the air damper is mounted, and thus, allow for a pressure build up in the inner space of the tubular stile member on which the air damper is mounted when a stile member of a collapsing ladder section is inserted in the inner space of that stile member;

and/or an obturator device, the obturator device comprising:

- a first obturator member at the bottom end of the tubular stile member of the collapsible ladder section on which the air damper has been mounted, which first obturator member is located at a side of the air damper that faces the adjacent ladder section, and
- a second obturator member located at the bottom end of the tubular stile member of the adjacent ladder section, i.e. the ladder section in which the stile member with the first obturator member is received when in the collapsed position, wherein the first obturator member and the second obturator member are configured to, when the collapsible ladder section is in the collapsed position, in combination provide additional throttling, preferably a blockage, of an air flow flowing through the throttle opening out of the stile member on which the air damper and the first obturator member are mounted.

It has been found that to provide throttling, or even blockage of an air flow out of the stile members of the collapsed ladder section, when the ladder section is in the collapsed position, allows for a better controlled collapsing behaviour.

In particular, the invention thus allows for providing similar dimensioned air dampers in each of the collapsible ladder sections, which reduces production costs. In prior art documents, the use of similar air dampers may cause significant differentiation in sliding speeds due to the difference in dimensions, weight, air gaps etc. between ladder sections.

By providing a throttle valve securing device and/or an obturator device, air leakage from the tubular stile member while receiving a collapsing ladder section is reduced, this enables a more equal time for each ladder section to slide from its extended position into its collapsed position.

The throttle valve securing device is configured to secure a throttle vale in its throttle position and to thus enable the throttle valve to not only throttle an air flow into the stile member on which the air damper has been mounted, but to also throttle an air flow out of that stile member. Thus, providing a throttle valve securing device allows for using a simple one way throttle valve in the air damper for retardation of gravity induced velocity of the collapsible ladder section on which it is mounted by throttling a flow of air into that stile member, and for substantially sealing the tubular stile member on which it is mounted to reduce air leakage, i.e. reduce the flow of air out of the stile member, while receiving collapsible ladder section.

The obturator device is configured to provide additional throttling of, or even seal the throttling opening of the air damper, to thus reduce air leakage via said throttle opening while the ladder section onto which the air damper is mounted is in the collapsed position and receives the stile member of a collapsing ladder section. According to the invention, the obturator device comprises a first obturator member at the bottom end of the tubular stile member on which the air damper is mounted, and a second obturator member located at the bottom end of the stile member in which the stile member with the first obturator member is received when in the collapsed position. Thus, the obturator device is only active when the ladder section comprising the first obturator member is in the collapsed position, in which position the first obturator member is located adjacent the second obturator member and the first and second obturator members cooperate to form an additional seal and/or throttle opening for an air flow passing through the throttle opening of the air damper.

In an embodiment, the obturator members are configured to provide a seal, i.e. are configured to block an air flow from passing between the obturator members. In an alternative embodiment, the obturator members are configured to define one or more tight gaps or openings between them to provide throttling in addition to any throttling already provide by the throttle valve. In his configuration the obturator members restrict the flow of air out of the stile member to such an extent that the obturator members significantly reduce the collapsing speed of a collapsing ladder section being received in that stile member.

In an embodiment, one of the obturator members is located on the air damper body defining the throttle opening, and preferably extends around the throttle opening, such that the first and second obturator member, in combination form a barrier between the throttle opening and the inner space of the tubular stile member in which the stile member with the air damper is received.

For example, the first obturator body can be a flexible rubber rib or ring secured in, or attached to, the air damper body, and extending around the throttle opening and the second obturator body is a contact surface that, when the stile member with the air damper is in the collapsed position, is positioned adjacent the flexible rubber ring or rib to provide a seal.

In an alternative embodiment, one of the obturator members is not located on the air damper body defining the throttle opening, but is fixed to the inside surface of the tubular stile member in which the air damper has been mounted.

In an embodiment, the air damper body has a body portion which is configured to receive at least part of the throttle valve to guide the throttle valve when it is moved between the throttle position and the release position. In such an embodiment, the air damper body for example comprises a valve seat that is shaped to guide the throttle valve when it is moved between the throttle position and the release position and/or the throttle valve is provided with friction members that engage the inside surface of the adjacent ladder section and the air damper body comprises guide slots for the friction members, In an embodiment, the throttle valve is a check valve configured to be moved into and/or out of the throttle position by the flow of air passing through the throttle opening, i.e. wherein the throttle valve is a relatively light valve that is resilient and/or movably supported such that the flow of air generated by the movement of the collapsible ladder section moves the valve into and/or out of the throttle position, for example is a Boston type of check valve configured to be pushed into the throttle position by the flow of air flowing through the throttle opening into the inner space of the tubular stile member of the collapsible ladder section on which the air damper is mounted when the collapsible ladder section is moved into the collapsed position.

In an embodiment, the Boston type of check valve is configured to only partially seal the throttle opening when in the throttle position, to allow for some air to pass through the throttle opening. In an alternative embodiment, the Boston type of check valve configured to fully seal the throttle opening when in the throttle position to block air from flowing through the throttle opening.

In an embodiment, the throttle valve securing device can be embodied as a support that engages the throttle valve when the ladder section with the air damper comprising the throttle valve moves into the collapsed position, and the securing device supports the throttle valve in the throttle position such that, when the pressure in stile member of the ladder section with the air damper comprising the throttle valve increases, the throttle member is not moved out of its throttle position. The throttle valve is thus secured in the throttle position.

In an embodiment, the throttle valve securing device is part of an end cap mounted in the stile member of the adjacent ladder section, preferably is part of an endcap that also comprises an air damper for retardation of gravity induced velocity of that adjacent ladder section.

It is submitted that in known collapsible ladder assemblies, in the collapsed position, the ladder sections rest against spacers provided on the outside of the ladder stiles, typically provided between the sports are or formed by the sports of the ladder sections. Thus, the end caps and air dampers provided in adjacent stile members of known ladder assemblies are spaced from each other when the ladder sections are in the collapsed position, at least are spaced to such an extent that they not in combination have a significant effect in throttling an air flow flowing out of a stile member via a throttle opening of an air damper.

In an embodiment, the throttle valve has a flexible substantially disc shaped valve body, which valve body is configured to cover at least part of the throttle opening when in the throttle position, and the throttle valve securing device is a support member having a support surface facing the valve body, which support surface substantially matches the shape of a surface of the valve member facing the throttle valve securing device such that the throttle valve securing device, when in engagement with the valve, supports the valve body to such an extent that it prevents the flexible valve body from flexing, buckling or bending, when the pressure on the valve side of the valve body increases.

In an embodiment, the throttle valve is a check valve configured to be moved relative to the throttle opening by frictional engagement of the inside surface of the tubular stile member of the adjacent ladder section, i.e. wherein the throttle valve is moveably supported and comprises one or more grip pads, which grip pads are each positioned adjacent the inside surface of the tubular stile member of the adjacent ladder section and make frictional contact with the inside surface, such that by moving the collapsible ladder section out of the extended position and into the collapsed position the throttle valve is moved from the release position into the throttle position, and vice versa.

In such an embodiment, the throttle valve securing device can be embodied as a support that engages the throttle valve and/or the grip pads to support the throttle valve in its throttle position, more in particular to thus secure the throttle valve in its throttle position.

In an embodiment each of the intermediate ladder sections is provided with a similar throttle valve, which throttle valves for each set of telescopically inserted stile members are located in line with each other, and which throttle valves are provided with a housing at a side hat faces the inner space of the stile member on which the air damper is mounted, which housing is configured to form the throttle valve securing device of the throttle valve mounted on the stile member that is telescopically received in the inner space of the stile member on which the air damper is mounted. Thus, in such an embodiment, when the ladder sections are all in the collapsed position, the air dampers are located one on top of the other, such that the housing of each lower air damper engages the throttle valve of the subsequent higher air damper.

In a further embodiment, the throttle opening is part of a throttle channel, which throttle channel extends between the throttle channel inlet opening at one end and a throttle channel inlet opening at an opposite end of the throttle channel. The throttle channel is preferably defined by a housing of the valve member, wherein the housing extends into the stile member, preferably along the longitudinal axis of the stile member, to enable contact between the housing and the valve member of an air damper of another collapsible ladder section, when the latter ladder section is in the collapsed position.

In a further preferred embodiment, the housing that acts as the throttle valve securing device comprises a support surface for engaging the throttle valve of an air damper mounted in a stile member that is telescopically received in the stile member in which the air damper with the above mentioned housing is mounted, and the throttle outflow opening is located in the support surface such that the support surface extends around the throttle outflow opening and such that, when the above mentioned housing engages the throttle valve of an air damper of a collapsed ladder section, the supported throttle valve seals the throttle outflow opening.

In an embodiment, the first obturator member is a flexible sealing body, for example a sealing ring, located on either the air damper body of the air damper with the throttle opening to be throttled or sealed by the obturator, or on a cap or an air damper body of an air damper that is located in the adjacent ladder section, wherein the second obturator member is a corresponding contact surface configured for engaging the first obturator member, and located on either the cap or the air damper body of the air damper that is located in the adjacent ladder section or on the air damper body respectively, and wherein the flexible sealing body and the corresponding contact surface are configured such that, when the collapsible ladder section is in the collapsed position, i.e. is received in the adjacent ladder section, the flexible sealing body and the corresponding contact surface either define one or more tight gaps between them that allow for a minimal air flow via the throttle opening or sealingly engage each other such that an air flow is blocked.

Thus, the invention allows for the first and second obturator member to be simple in design. Furthermore, in a further embodiment, the flexible sealing body is embodied such that it allows for some compression and/or resilient deformation when in contact with the contact surface. For example, in an embodiment, the resilient body is configured as a rubber rib element having a height parallel to the longitudinal axis of the stile member, which height allows for significant resilient compression, and a contact surface perpendicular to, or at a shaper angle with, the longitudinal axis of the stile member. Thus, the relative position of the first and second obturator member, when the ladder section is collapsed, is less critical in that if they are positioned closer together than intended this is compensated by additional deformation of the flexible element. Thus, the tolerance regarding the dimensions and position of these components during manufacturing is less critical.

In an embodiment, the obturator device comprises an obturator surface located on the air damper body and a corresponding obturator surface located on a sealing cap or air damper body mounted in an adjacent ladder section, which obturator surfaces, when the collapsible ladder section is in the collapsed position, are positioned parallel to each other and adjacent to each other such that they define one or more tight gaps between them to allow for a minimal air flow via the throttle opening.

In a further embodiment, the obturator surfaces extend substantially parallel to a longitudinal axis of the stile members, such that the move along each other when the collapsible ladder section is moved into or out of the collapsed position.

In an embodiment, the first and second obturator member are obturator surfaces, i.e. surface areas which in the active position, i.e. the position in which they provide additional throttling, preferably a blockage, of an air flow, are positioned parallel to each other such that they define an annular gap between them. In such an embodiment the obturator surfaces are preferably positioned at a mutual distance, i.e. the height of he gap, in the range of 0.5 mm-2 mm, preferably at a distance of less than 2 mm, preferably less than 1.5 mm for example at a distance of 1 mm. Furthermore, in such an embodiment the length of the gap, i.e. the distance the air low has to travel to between the two parallel obturator surfaces, preferably is in the range of 2 mm-12 mm, preferably is at least 3 mm, for example 5 mm.

In an embodiment, the air damper body is configured as a cap that is mounted in the bottom end of a stile member, which cap is preferably configured as a barrier member that substantially seals of the bottom end of the stile member such that it prevents air from flowing into and out of that stile member at the bottom end thereof other than via the throttle opening, or throttle openings, defined by the air damper body.

In an embodiment, the air damper body forms a valve seat for the throttle body, preferably located on a central axis of the tubular stile member onto which the air damper is mounted, preferably such that a central axis of the valve seat coincides with the central axis of the tubular stile member, which valve seat is configured for receiving at least part of the throttle valve and for guiding said throttle valve between the throttle position and the release position, preferably along the central axis of the tubular stile member.

In an embodiment, the air damper body of some of the air dampers defines additional openings which are not covered by the valve member of the throttle valve when in the throttle position, to allow air to flow from the adjacent ladder section into the ladder section onto which the valve member has been mounted, while the valve member is in the throttle position. Preferably, in such an embodiment the valve member is configured for sealing the throttle opening of the throttle valve.

Such an embodiment is in particular beneficial when openings available for air to escape the inner space of a stile member, e.g. gaps between the telescopically received stile members and/or openings in the stile members, are insufficient to allow for enough air to escape to obtain a sufficiently fast movement of the collapsing ladder section, when the throttle valve securing device and/or the obturator device restrict air flow via the throttle opening.

In an embodiment, the air damper body has an upper fastening portion which is configured to receive the bottom end of a tubular stile member to mount the air damper on the stile member.

In an embodiment, the air damper body, preferably an upper fastening portion of the air damper body, is provided with integral elastic fasteners that are adapted to snap into associated apertures in the tubular stile member. For example, the damper body is an injection moulded component comprising click fingers, which click fingers engage apertures in the stile members to secure the air damper body, and thus the air damper, in the stile member.

In an embodiment, the air damper comprises a housing, preferably a housing comprising a top housing member at one side of the air damper body and a bottom housing member at an opposite side of the air damper body, which housing forms a throttle channel comprising the throttle opening. In a further embodiment, the top housing member and the bottom housing member are, from opposite sides with one end inserted into the throttle opening provided in the damper body, preferably are provided with click fingers that engage aperture in the damper body to secure the housing components, during manufacturing. This allows for a simple and efficient production process.

In an embodiment, the air damper comprises a housing, preferably a housing comprising a top housing member at one side of the air damper body and a bottom housing member at an opposite side of the air damper body, which housing forms a throttle channel comprising the throttle opening.

In an embodiment, the air damper body and/or a housing of the air damper forms the throttle valve securing device.

In an embodiment, the air damper body and/or a housing of the air damper forms the first and/or second obturator member.

In an embodiment, wherein the throttle valve securing device is configured as a body providing a support surface for engaging a throttle valve and provided with a circumferential side surface that functions as a first obturator member. For example, a top housing member of an air damper is provided with a top surface that engages the throttle valve of an air damper, when the stile member in which that air damper is mounted, is in the collapsed position. thus the top surface of the housing member secures the throttle valve in the throttle position.

In an embodiment, the obturator device comprises a first obturator member in the form of a skirt, i.e. an annular wall having an inside circumferential surface, and a second obturator member in the form of a cylindrical body comprising a circumferential outer wall, i.e. having an outside circumferential surface, and wherein, in a working position, i.e. when the collapsible ladder section is in the collapsed position, the skirt is lowered over the cylindrical body such that the inside circumferential surface of the skirt and the outside circumferential surface of the cylindrical body are located adjacent to each other and either contact each other or define a narrow gape to block or throttle a flow of air. When the collapsible ladder section is moved into the collapsed position, the skirt slides over the cylindrical housing, such that the cylindrical housing is. At least partially, received in the skirt when the collapsible ladder section is in the collapsed position. Such a configuration is especially beneficial since, the tolerance regarding the dimensions and position of these components during manufacturing is less critical.

The invention furthermore provides a stepladder having a first stepladder assembly and a second stepladders assembly hinged to one another so as to be in a storage position folded against one another and an operative position similar to an inverted V at least one of the stepladder assemblies being a ladder assembly according to the invention.

The invention furthermore provides work platform including a ladder assembly according to the invention.

In a preferred embodiment, the air dampers comprise an air damper body, which air damper body is configured as a cap that is mounted in the open end of the stile member, preferably such that the throttle opening defined by the air damper body is located at the center of the stile member In an embodiment, the air dampers each comprise multiple throttle openings and one or more throttle valves for at least partially sealing those openings, when the stile member in which the dampers are mounted are in the collapsed position. Preferably, for each of the throttle valves is provided a throttle valve securing device and/or an obturator member.

In an embodiment, the throttle valve is configured as a check valve, preferably a one-way check valve of the Boston type. The valve body of a Boston type check valve comprises a rubber flap that, when the valve body is in the throttle position, lets air flow out of the stile member but does not let flow air into the stile member onto which the valve member has been mounted.

A check valve, or non-return valve or one-way valve, is a valve that normally allows fluid to flow through it in only one direction. Typically, check valves are two-port valves, meaning they have two openings, one for fluid to enter and the other for fluid to leave. The invention allows for using a check valve to throttle or block a flow of air flowing into a stile damper body during collapsing of the ladder section comprising that stile member, and to throttle or block a flow of air flowing out of that stile damper body when it receives a stile member of a collapsing ladder section.

It is submitted that many types of check valves can be used with the invention. For example a diaphragm check valve, which comprises a flexing rubber diaphragm positioned to create a normally-closed valve, and which can be opened by a pressure difference, known as the pressure differential. When the pressure on the upstream side is greater than the pressure on the downstream side, i.e. differs with said pressure differential, the check valve opens allowing flow of air out of the stile member. Once positive pressure stops, the diaphragm automatically flexes back to its original closed position. In such an embodiment, according to the invention a throttle valve securing device can be provided to secure the diaphragm in the closed position. In addition, or as an alternative, an obturator device can be provided.

In an embodiment, the throttle valve is embodied as a lift-check valve, i.e. a check valve in which the disc, sometimes called a lift, can be lifted up off its seat by higher pressure of inlet or upstream fluid to allow flow to the outlet or downstream side. A guide keeps motion of the disc on a vertical line, so the valve can later reseat properly. When the pressure is no longer higher, gravity or higher downstream pressure will cause the disc to lower onto its seat, shutting the valve to stop reverse flow. In such an embodiment, according to the invention a throttle valve securing device can be provided to secure the disc in the closed position. In addition, or as an alternative, an obturator device can be provided.

In an embodiment, the throttle valve is embodied as a lift-check valve, i.e. a check valve similar to the lift check valve. However, this valve generally has a spring that will 'lift' when there is pressure on the upstream side of the valve. The pressure needed on the upstream side of the valve to overcome the spring tension is called the 'cracking pressure'. When the pressure going through the valve goes below the cracking pressure, the spring will close the valve to prevent back-flow in the process.

In an embodiment, the throttle valve is configured as a one-way check valve of the Boston valve type. The valve body of a Boston type check valve comprises a rubber flap or diaphragm, positioned to create a normally-closed valve, and which can be opened by a pressure difference, known as the pressure differential. When the pressure on the upstream side is greater than the pressure on the downstream side, i.e. differs with said pressure differential, the check valve opens allowing flow of air out of the stile member. Once positive pressure stops, the diaphragm automatically moves or flexes back to its original closed position.

In an alternative embodiment, the check valve is configured such that the rubber flap or diaphragm is positioned such that it creates a normally-opened valve. For example, the diaphragm can be mounted such that when the ladder assembly is in the upright and extended position, gravity lowers the diaphragm in the release position. During collapse of the ladder section on which the valve is mounted, the pressure difference, c.q. the airflow flowing into the stile members of the collapsing ladder section, generated by inserting the ladder section into an adjacent ladder section, flexes and/or moves the diaphragm into its closed position.

In such an embodiment, according to the invention a throttle valve securing device can be provided to secure the flap or diaphragm in the closed position. In addition, or as an alternative, an obturator device can be provided.

Other types of check valves, or combinations of above mentioned types of check valves, may also be used with the invention.

The invention furthermore provides a telescopic ladder assembly comprising a ladder assembly according to the present invention, wherein the air damper comprises a throttle valve in the form of a throttle opening, thus without an active, i.e. movably mounted, throttle valve.

Further objects, embodiments and elaborations of the apparatus and the method according to the invention will be apparent from the following description, in which the invention is further illustrated and elucidated on the basis of a number of exemplary embodiments, with reference to the drawings.

BRIEF DESCRIPTION OF THE DRAWINGS

FIG. 10 shows a perspective view of a throttle valve that is moved into and out of the throttle position by frictional engagement with an inside surface of the stile member the stile member with the air damper is inserted to.

DETAILED DESCRIPTION OF THE INVENTION

Figure 1:
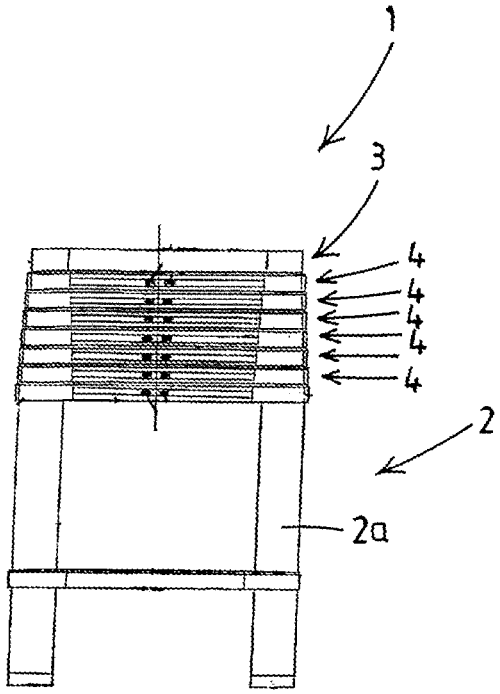
FIG. 1 shows in front view a telescopic ladder according to the invention in collapsed condition.
Figure 2:
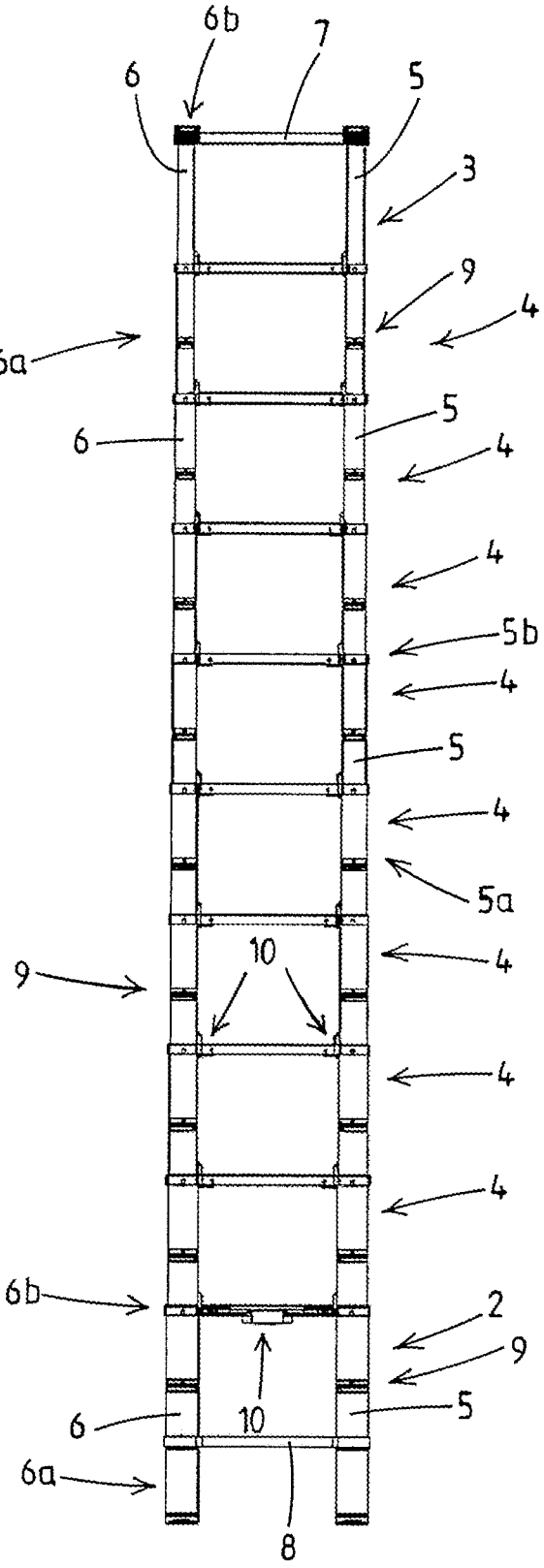
FIG. 2 shows the ladder similar to the one shown in FIG. 1 in extended condition.

FIGS. 1 and 2 show an example of a telescopically extendable and collapsible ladder assembly according to the invention, here embodied as a straight telescopic ladder 1. The ladder assembly may also be part of another "ladder product" such as a stepladder or combination ladder, a work platform with ladder like telescopic legs, etc.

The ladder assembly 1 has a bottom ladder section 2, a top ladder section 3, and multiple intermediate ladder sections 4, in the particular embodiment shown in FIG. 1 six. It is noted that the ladder sown in FIG. 2 is similar to the ladder shown in FIG. 1, but comprises eight intermediate ladder sections.

Each of the ladder sections 2, 3, 4 comprises two tubular stile members 5, 6, each having a bottom end 5*a*, 6*a* and a top end 5*b*, 6*b* and each tubular stile member defining an inner space. The tubular stile members 5, 6 are arranged parallel to each other and are interconnected at the top end by a ladder rung 7 to form a U-shaped ladder section, and in this example the tubular stile members of the bottom ladder section 2 are furthermore connected by a bottom ladder rung 8.

The top ladder section 3 and the intermediate ladder sections 4 are collapsible ladder sections. Of each collapsible ladder section the bottom ends 5*a*, 6*a* of the tubular style members 5, 6 are telescopically inserted into the top end 5*b*, 6*b* of the tubular stile members 5, 6 of an adjacent ladder section to allow the collapsible ladder section to be moved relative to the adjacent ladder section between a collapsed position and an extended position, and thus enable collapse and extension of the telescopic ladder.

In the exemplary embodiments shown in FIG. 1 and FIG. 2, the collapsible ladder sections are each provided with an air damper 9 at the bottom end 5*a*,6*a* of one of at least one of the tubular stile members 5,6. It is noted that the ladder assembly shown in FIG. 2 is depicted partially in cross section, such that the air dampers 9 mounted in the stile members are shown.

The air dampers 9 provide retardation of gravity induced velocity of the collapsible ladder sections upon collapse of the ladder sections on the basis of throttling an airflow flowing out of the inner space of the tubular stile member of the adjacent ladder section into the inner space of the tubular stile member of the collapsible ladder section being inserted into the inner space of the tubular stile member of the adjacent ladder section.

Each stile member 5, 6 of the bottom ladder section 2 in the exemplary embodiment shown is provided with a ground engaging foot member (e.g. of rubber or the like).

The exemplary ladder assembly 1 shown further comprises automatic latch mechanisms for locking the telescopically inserted tubular stile members of the collapsible ladder sections relative to the adjacent ladder sections when the collapsible ladder section are in the extended position, the latch mechanisms being associated with actuators for unlocking the tubular stile members in order to allow for collapsing of the ladder assembly. These actuators 10 are manually operated actuators and automatically operated actuators, which are both indicated with reference numeral 10 in FIG. 1. The manually operated actuators 10 are slideable actuator and are arranged centrally on the bottom side of a rung of the bottom ladder section so as to be operable simultaneously with a single hand. The automatically operated actuators 10 are, in the exemplary embodiment shown, provided in the form of fingers located at the top of the rungs and extending along the stile members. When a ladder section moves in the collapsed position, the fingers provided on top of the ladder rung of the lower ladder section engage a latch mechanism provided in the sport of the collapsing ladder section, by which action the fingers unlock the stile members of that ladder section, such that the ladder sections collapses and the process is repeated for the next collapsible ladder section. Thus, the collapsible ladder sections collapse one after the other.

The rungs 7 are connected to the associated stile members 5, 6 via connectors. In the preferred embodiment shown, the fingers are an integral component of the connectors, which connectors are injection moulded components.

As explained, an issue related to telescopic ladders such as ladders shown in FIG. 1 and FIG. 2, is the velocity of the telescopic section when the ladder is collapsed. In order to retard said velocity multiple of the ladder sections are preferably provided with damper members that provide retardation of gravity induced velocity of the ladder section upon collapse or extension of the ladder section.

Figure 3:
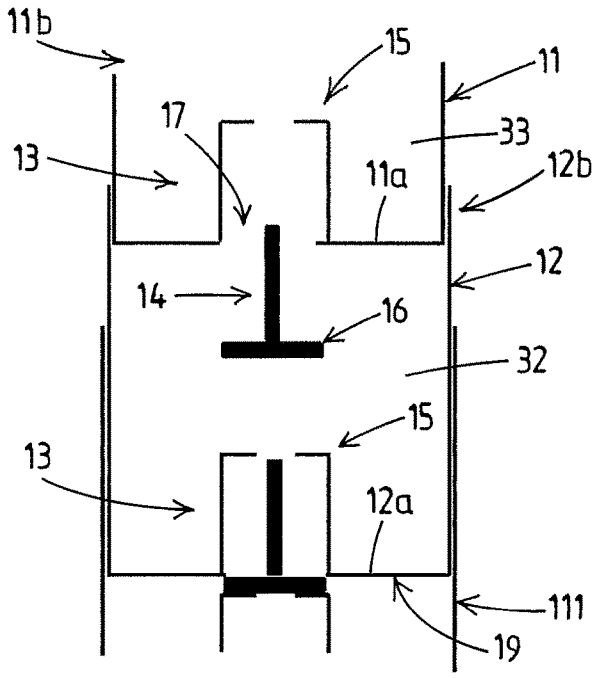
FIG. 3 shows a schematic view in cross section of a first stile member that is telescopically received in a second stile member in an extended position, which second stile member is telescopically received in a third stile member which is partially shown, which stile members are provided with an air damper comprising a throttle valve and a throttle valve securing device according to the invention.

FIG. 3 shows a schematic view in cross section of a first stile member 11 that is telescopically received in a second stile member 12 in an extended position, in which the bottom end 11*a* of the first stile member 11 is located away from the bottom end 12*a* of the second stile members 12. The second stile member 12 is telescopically received in a third stile member 111 in a collapsed position.

Figure 4:
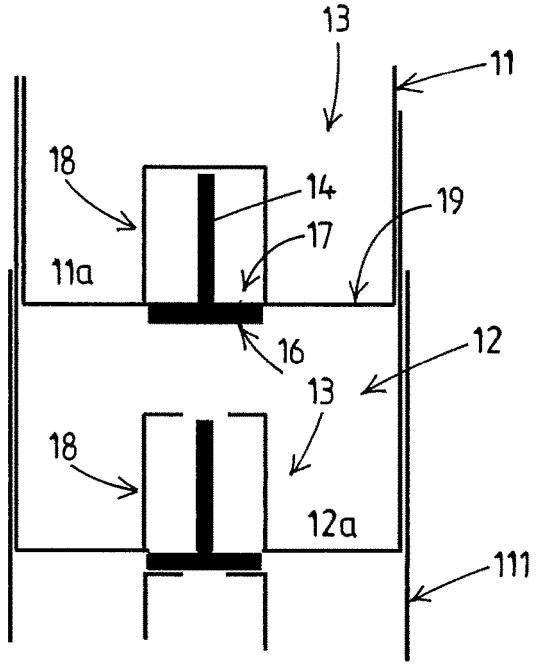
FIG. 4 shows a schematic view in cross section of the stile members of FIG. 3, while the first stile member is moved into the collapsed position.
Figure 5:
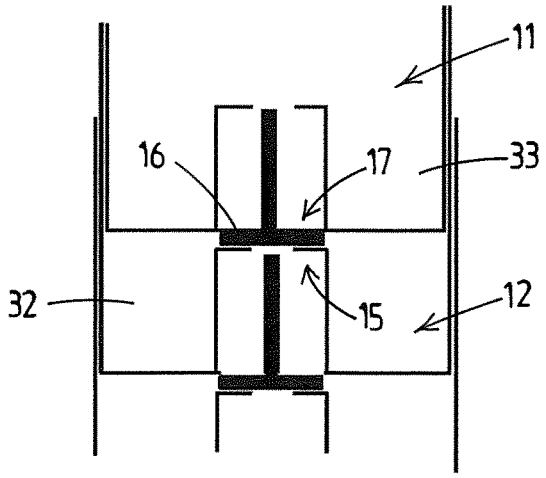
FIG. 5 shows a schematic view in cross section of the stile members of FIG. 3, with the first stile member in the collapsed position.

In FIGS. 3-5 the third stile member 111 is part of a bottom ladder section, and is provided with a ground engaging foot member (e.g. of rubber or the like), not shown. The explanation below will focus on the first and second stile member. Therefore, the third stile member 111 and its components are only partially depicted.

It is noted that for explanatory reasons, the stile members in the FIGS. 3-6 have been depicted way shorter than they will be in practice.

The stile members 11, 12 are each provided with an air damper 13. The air dampers 13 comprise a throttle valve 14 and a throttle valve securing device 15 according to the invention.

FIG. 4 shows the first stile member 11 and the second stile member 12, while the first stile member is moving into the collapsed position, i.e. into the downward direction.

FIG. 5 shows the first stile member 11 and the second stile member 12, with the first stile member in the collapsed position, in which the bottom end 11*a* of the first stile member 11 is located near the bottom end 12*a* of the second stile members 12.

In the configuration shown in FIGS. 3-5, the first stile member 11 and the second stile member 12 are both stile members of intermediate ladder sections. Because FIGS. 3-5 show the first stile member 11 being moved from an extend position into a collapsed position, in which it is telescopically received in the inner space 32 of the second stile member, here below the first stile member is also referred to as the stile member of a collapsible ladder section while the second stile member is referred to as the stile member of an adjacent ladder section.

It should be noted that herein the intermediate ladder sections and the top ladder section of a ladder assembly are referred to as a collapsible ladder section when the particular ladder section is the ladder section that is moved, either from the extended position into the collapsed position or from collapsed position into the extended position.

Typically in this context, the focus is on the lower end of the tubular stile members of that collapsible ladder section, i.e. the part of the ladder section that is being received into or extended from the top ends of the adjacent ladder section.

The intermediate ladder sections and the bottom ladder section are referred to as an adjacent ladder section when the particular ladder section is the passive ladder section, is the ladder section into which the collapsible ladder section is inserted or from which the collapsible ladder section is extended.

Typically in this context, the focus is on the upper end of the tubular stile members of that adjacent ladder section, i.e. the part of the ladder section that in which stile members of the collapsible ladder are telescopically received.

As set out above, collapsible ladders comprise multiple ladder sections which telescopically collapse in a sequential order. Typically, the ladder is collapsed from bottom to top, starting with the first intermediate ladder section. Once the first intermediate ladder section has been received in the bottom ladder section, the second intermediate ladder section collapses and is received in the first intermediate ladder section, etc. Thus, while the first intermediate ladder section is inserted into the bottom ladder section it is referred to as the collapsible ladder section, and once the first intermediate ladder section has been received in the bottom ladder section, and the second intermediate ladder section collapses the first intermediate ladder sections is referred to as the adjacent ladder section with respect to the second intermediate ladder section, etc.

In FIGS. 3-5 the first stile member 11, the collapsing ladder section, is provided with an air damper 13, which is located within the tubular stile member at a bottom end 11*a* thereof. The air damper 13 comprises an air damper body 16 defining a throttle opening 17. The throttle opening 17 provides an air path that enables air to flow out of the tubular stile member 12 of the adjacent ladder section into the tubular stile member 11 of the collapsible ladder section on which the air damper 13 is mounted and vice versa.

The air damper 13 has a throttle valve 18, which throttle valve is located at the throttle opening 17, at a side of the air damper 13 that faces the adjacent ladder section 12. The throttle valve 18 is supported such that it is movable relative to the throttle opening 17 between a release position, shown in FIG. 3, and a throttle position, shown in FIG. 4 and FIG. 5.

In the exemplary embodiment that is schematically shown in FIGS. 3-5, the throttle valve 18 is a check valve configured to be moved relative to the throttle opening 17 by the flow of air between the release position and the throttle position. In such an embodiment, the throttle valve is a relatively light valve that is resilient and/or movably supported such that the flow of air generated by the movement of the collapsible ladder section moves the valve into and/or out of the throttle position.

In the embodiment shown, the throttle valve 18 is Boston type of check valve configured to sealingly cover the throttle opening when in the throttle position. During the collapse of the ladder assembly, the throttle valve is moved into the throttle position, while during extension of the ladder assembly, the throttle valve is moved into the release position.

In the release position the throttle valve 18 is located away from the throttle opening 17 to allow for a maximum air flow to flow through the throttle opening out of the stile member 11, on which the air damper 13 is mounted. In this position, upon extending the collapsible ladder section comprising the stile member 11, the throttle valve 13 in the release position enables aerating the inner space 32 of the stile member 12 of the lower ladder section, out of which the stile member 11 of the collapsible ladder section is moved. Thus, the throttle valve prevents an underpressure to evolve in the inner space 32 of the stile member 12 of the lower ladder section, and thus facilitates moving the stile member 11 of the collapsible ladder section from the collapsed position into the extended position.

In the throttle position the throttle valve 18 is located adjacent to the throttle opening 17 to throttle, preferably block, an air flow flowing through the throttle opening into the stile member 11 of the collapsible ladder section on which the air damper 13 is mounted. In this position, upon collapsing of the collapsible ladder section, the air damper 13 reduces the outflow options of stile member 12 and thus enables a pressure to build up in the inner space 32 of the stile member 12 when the stile member 1 of the collapsible ladder section is moved into that inner space 32. This pressure build up provides the retardation of the gravity induced velocity of the collapsible ladder sections during collapse of the collapsible ladder section.

According to the present invention, each of the air dampers of the ladder assembly is provided with a throttle valve securing device and/or with an obturator device to provide throttling or even blockage of an air flow out of the stile members on which the air valve is mounted, while the ladder section is in the collapsed position.

In the embodiment shown in FIGS. 3-5, the air damper 13 is provided with a throttle valve securing device 15.

In the exemplary embodiment shown, the throttle valve securing device 15 is located at the bottom end 12*a* of the stile member 12 of the adjacent ladder section. The securing device 19 is configured for cooperating with, in the particular embodiment shown to engage and support, the throttle valve 18 of the air damper 13 when the stile member 11 of the collapsible ladder section is in the collapsed position, shown in FIG. 5.

When the stile member 11 of the collapsible ladder section is in the collapsed position, the throttle valve securing device 15 secures the throttle valve in its throttle position and thus enables the throttle valve 18 to throttle an air flow flowing through the throttle opening 17 out of the tubular stile member 11 on which the air damper 13 is mounted. Thus, when the pressure in the stile member 11 of the ladder section with the air damper comprising the throttle valve increases, the throttle member is not moved out of its throttle position. The throttle valve is secured in the throttle position and thus enables a pressure build up in the inner space 33 of the tubular stile member 11 when a stile member of a collapsing ladder section is inserted in the inner space 33.

In the exemplary embodiment shown, the throttle valve 18 has a flexible substantially disc shaped valve body 20, which valve body is configured to cover the throttle opening 17 when in the throttle position. The throttle valve securing device 15 is a support member having a support surface facing the valve body 20, which support surface substantially matches the shape of a surface of the valve member facing the throttle valve securing device. The throttle valve securing device 15, when in engagement with the throttle valve 15, supports the valve body 20 to such an extent that it prevents the flexible valve body from flexing, buckling or bending, when the pressure on the valve side of the valve body increases.

Furthermore, in the embodiment shown, the throttle valve securing device 15 is part of an end cap 19, which end cap is mounted in the stile member 12 of the adjacent ladder section. In the preferred embodiment shown, the end cap 19 also comprises an air damper 13' for retardation of gravity induced velocity of that adjacent ladder section.

Figure 6:
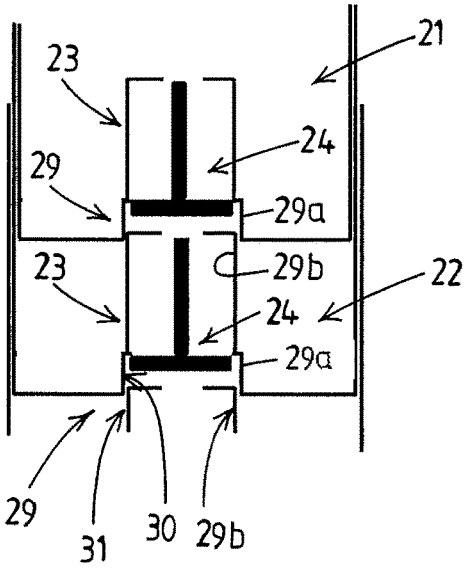
FIG. 6 shows a schematic view in cross section of a first stile member that is telescopically received in a second stile member in a collapsed position, which stile members are provided with an air damper comprising a throttle valve and an obturator device according to the invention.

FIG. 6 shows a schematic view in cross section of a first stile member 21 that is telescopically received in a second stile member 22 in a collapsed position, similar to the condition shown in FIG. 5. In contrast with the embodiment shown in FIGS. 3-5, the stile members 21,22 are provided with an air damper 23 comprising a throttle valve 24 and an obturator device 29 according to the invention.

The obturator device 29 comprises a first obturator member 29*a* and a second obturator member 29*b*. The first obturator member 29*a* is provided in the form of an obturator surface 30 located on the air damper body 26. The second obturator body 29*b* is provided in the form of a corresponding obturator surface 31 located on the air damper body 26 of an air damper 23 provided in the stile member 22 of the lower ladder section.

The first obturator member 29*a* is located at the bottom end 21*a* of the tubular stile member 21 of the collapsible ladder section on which the air damper 23 has been mounted. In the exemplary embodiment shown in FIG. 6, the first obturator member 29*a* is an integrated component of the air damper body 16 defining the throttle opening 27. The first obturator member 29*a* is located at a side of the air damper 23 that faces the stile member 22 of the adjacent ladder section.

The second obturator member 29*b* is located at the bottom end 22*a* of the tubular stile member 22 of the adjacent ladder section, i.e. the ladder section in which the stile member 11 with the first obturator member 29*a* is received when in the collapsed position. In the exemplary embodiment shown, the second obturator member 29*b* is an integrated component of the air damper body 26. The second obturator member 29*b* is located at a side of the air damper 23 that faces the stile member 22 of the adjacent ladder section.

The first obturator member 29*a* and the second obturator member 29*b* are configured to, when the collapsible ladder section 21 is in the collapsed position, in combination provide additional throttling, of an air flow flowing through the throttle opening 27 out of the stile member 21 on which the air damper 23 is mounted.

Thus, when the collapsible ladder section is in the extended position, the obturator members are located away from each other and do not influence the flow of air through the throttle opening. When the collapsible ladder section is in the collapsed position, shown in FIG. 6, the obturator surfaces 30,31 are positioned parallel to each other and adjacent to each other such that they define a tight annular gap between them to allow for a minimal air flow via the throttle opening 27.

It has been found that throttling, or even blocking, an air flow flowing out of the stile members of the collapsed ladder section, when the ladder section is in the collapsed position, allows for a better controlled collapsing behaviour. By providing a throttle valve securing device and/or an obturator device, air leakage from the tubular stile member while receiving a collapsing ladder section is reduced, this enables a more equal time for each ladder section to slide from its extended position into its collapsed position.

In the embodiment shown in FIG. 6, when the collapsible ladder section is in the collapsed position, the obturator surfaces 30,31 of the obturator members extend around the throttle opening 27, such that the first obturator member and the second obturator member in combination form a barrier in the form of the annular gap, which barrier is located between the throttle opening and the inner space of the tubular stile member in which the stile member with the air damper is received.

The obturator members are only active, i.e. limit the air flow through the throttle opening, when the collapsible ladder section is in the collapsed position.

In an alternative embodiment, the first obturator member is not located on the air damper body defining the throttle opening, but is fixed to the inside surface of the tubular stile member in which the air damper has been mounted.

In yet another alternative embodiment, the first obturator body is a flexible sealing body, e.g. a flexible rubber rib or ring, secured in, or attached to, the air damper body, and extending around the throttle opening. In addition, the second obturator body is a contact surface that, when the stile member with the air damper is in the collapsed position, is positioned adjacent the flexible rubber ring or rib such that they sealingly engage each other to provide a sealing closure between the obturator members. Thus, they form a barrier between the throttle opening and the inner space of the tubular stile member in which the stile member with the air damper is received and prevent an air flow to flow via the throttle opening out of the inner space of the stile member on which the air damper is mounted.

FIGS. 7*a*-9*b* show detailed views in cross section of three subsequent positions of part of a ladder assembly 41 according to the invention. It should be noted that, as with the schematic view shown in FIGS. 3-6, the stile members in the drawings are shortened for explanatory reasons, and will in practice have a large length to width ratio.

The FIGS. 7*a*-9*b* show a first stile member 42, a second stile member 43 and a third stile member 44, the third stile member 44 being part of a bottom ladder section, the first and second stile members 42,43 being part of an intermediate ladder section.

The first stile member 43 and second stile member 43 are each provided with an air damper 45 comprising a throttle opening 46 and a throttle valve 47. In the embodiment shown in FIGS. 7*a*-9*b*, the air dampers 45 are provided with both a throttle valve securing device 48 and an obturator device 49, the latter comprising a first obturator member 49*a* and a second obturator member 49*b*, according to the invention.

In the preferred embodiment shown, the throttle valve securing device 48 and the obturator device 19 in the intermediate ladder sections are both integrated into the hosing of the air dampers 45. The air dampers 45 of these stile members comprise an air damper body, which air damper body defines the throttle opening, in the form of a cap 50 that is mounted in the bottom ends of the stile member. The air damper body is configured to seal of the bottom end of the stile members such that an air flow can at the bottom end of the stile member only enter the stile member via the throttle opening.

Furthermore, in the preferred embodiment shown, the air damper 45 comprises a top housing member 51 and a bottom housing member 52. The top and bottom housing member are mounted on the inside of the air damper body, i.e. the side of the air damper that faces the inner space of the stile member, and on the outside of the air damper body respectively, and both form a wall around the throttle opening. Thus, the housing members define a throttle channel 53, which throttle channel comprises the throttle opening. The throttle channel extends between a throttle channel inlet/outlet opening at one end and a throttle channel inlet/outlet opening at an opposite end of the throttle channel.

In the preferred embodiment shown, the throttle housing top member is configured to function a throttle valve securing device and as a second obturator member of an obturator device, i.e. to cooperate with a first obturator member.

The throttle housing bottom member is configured as a first obturator member, i.e. is configured to cooperate with a second obturator member. In the particular embodiment shown the bottom housing members of the air valves are configured to cooperate with the top housing member of an air damper located in a lower ladder section, or with the second obturator member located in the bottom ladder section.

In the embodiment shown in FIGS. 7*a*-9*b*, the throttle valve are configured to be moved by air pressure, more in particular an air flow flowing through the throttle channel and throttle opening into the stile member onto which the air valve is mounted, form the release position into the throttle position.

Figure 7A:
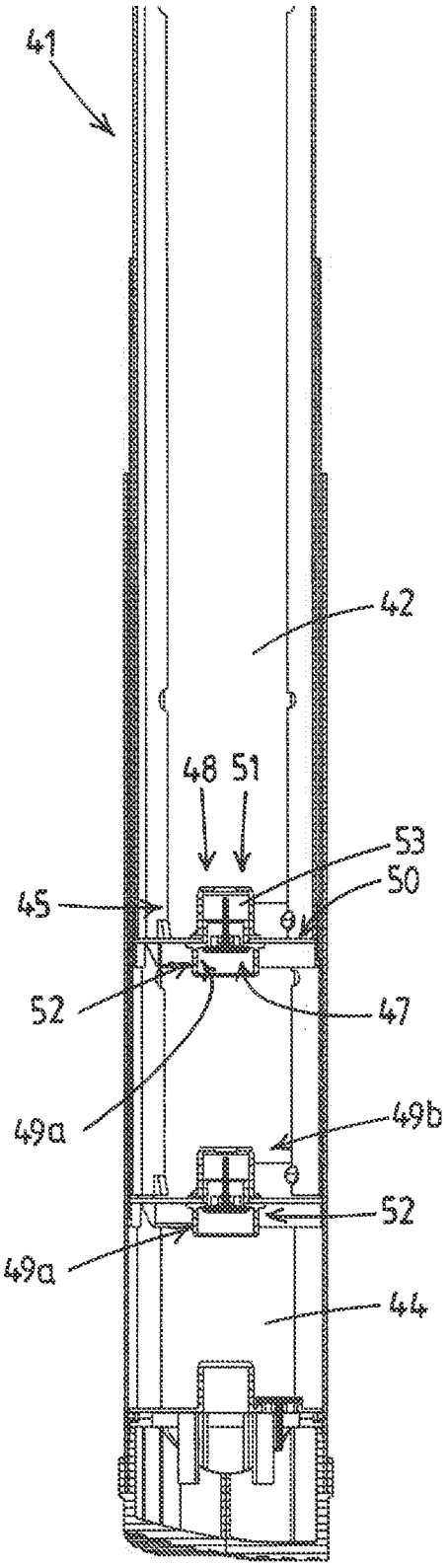
FIGS. 7*a* and 7*b* show a side view and a perspective view, respectively, in cross section of a first stile member, a second stile member and a third stile member, in an extended position, which first and second stile members are provided with an air damper comprising a throttle valve, and which air dampers are provided with both a throttle valve securing device and an obturator device according to the invention.
Figure 7B:
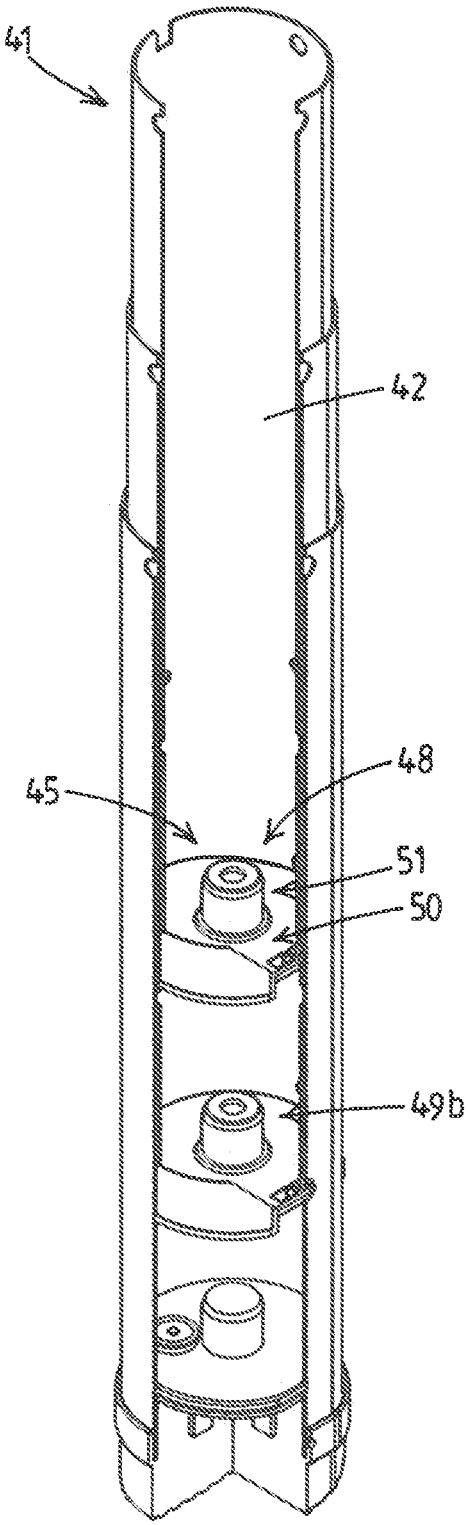

FIGS. 7*a* and 7*b* show the stile members with the intermediate ladder sections in an extended position. FIGS. 7*a* and 7*b* shows the throttle valves all in their throttle position. However, when the stile members are in rest, and there is thus no air flow flowing form one stile member to the other, these throttle valves are in the release position, which is not shown in the figs.

Figure 8A:
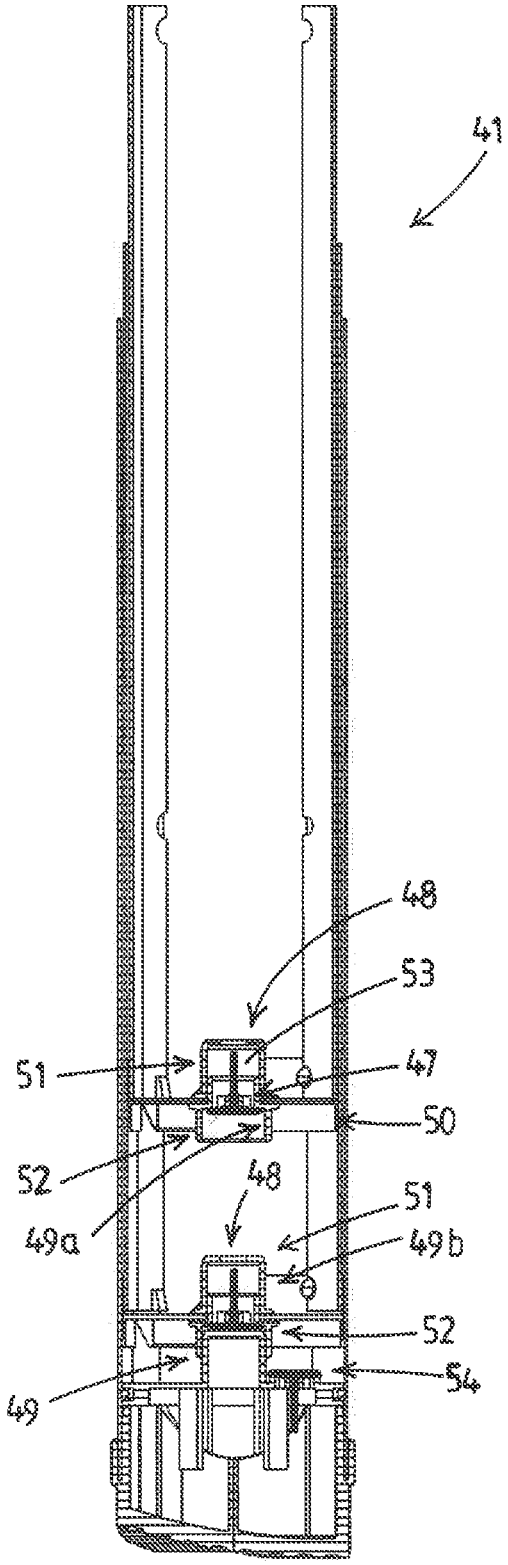
FIGS. 8*a* and 8*b* show a side view and a perspective view, respectively, in cross section of the first stile member, the second stile member and the third stile member of FIGS. 7*a* and 7*b* with the second stile member in the collapsed positon.
Figure 8B:
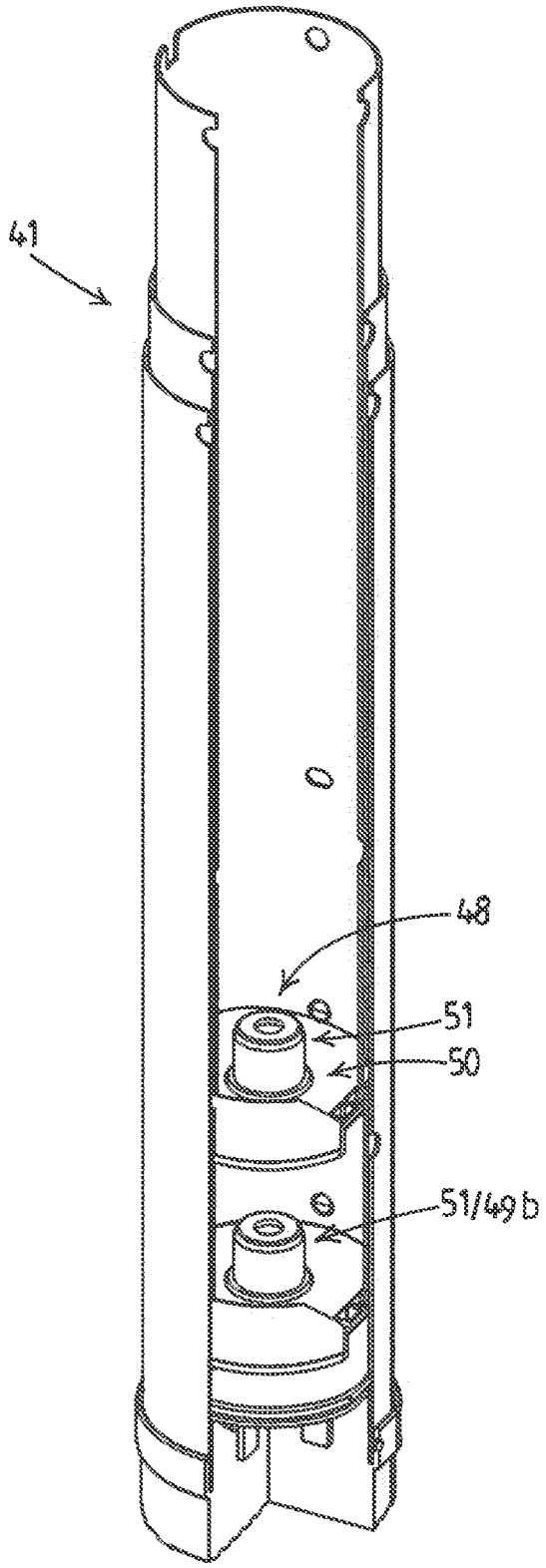

FIGS. 8*a* and 8*b* show the stile members with second intermediate ladder section moved into the collapsed positon. In this position, the throttle valve rests on the throttle valve securing device 48, which in the embodiment shown is provided in the form of a protrusion 63 on a cap at the bottom end of the stile member of the bottom ladder section. The protrusion forms a table that supports the throttle valve in its throttle position, and thus prevents it from buckling or moving in case of a raised air pressure in the stile member on which the air damper is mounted, i.e. the second stile member.

According to the invention, the throttle valve securing device 48 is configured to secure the throttle vale 47 in its throttle position and to thus enable the throttle valve to not only throttle an air flow into the stile member on which the air damper has been mounted, but to also throttle an air flow out of that stile member. Thus, providing the throttle valve securing device 48 allows for using a simple one way throttle valve in the air damper 45 for retardation of gravity induced velocity of the collapsible ladder section on which it is mounted, and for substantially sealing the tubular stile member on which it is mounted to reduce air leakage while receiving collapsible ladder section.

From the figures it is clear that in the embodiment shown, the top housing member is provided with a height such that it's top surface can engage the valve member of the air damper in the other stile member. The top housing member is thus used to bridge the gap between the air dampers, which gap typically is present in prior art ladder assemblies in which the air dampers are configured as end caps mounted in the bottom end of the stile members. Thus, in such an embodiment according to the invention, the air dampers are mounted one on top of the other, i.e. contact each other, to thus enable the air dampers to function as a throttle valve securing device and an obturator device, when the ladder sections are in the collapsed position.

Figure 9A:
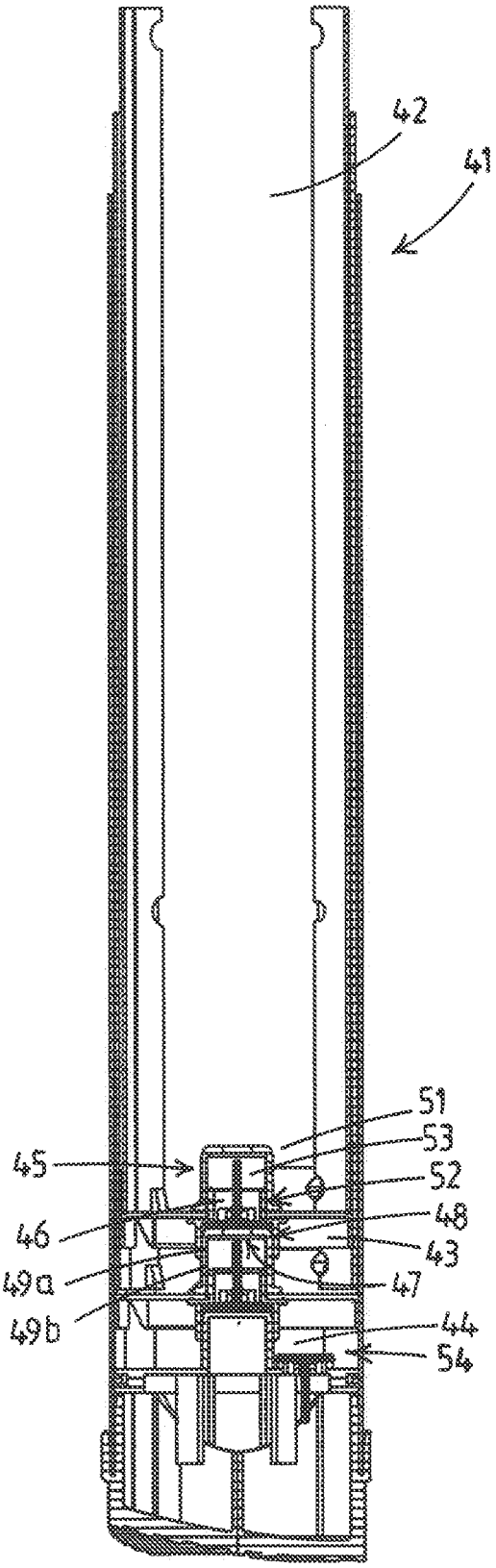
FIGS. 9*a* and 9*b* show a side view and a perspective view, respectively, in cross section of the first stile member, the second stile member and the third stile member of FIGS. 7*a* and 7*b* with the second stile member and the third stile member in the collapsed positon.
Figure 9B:
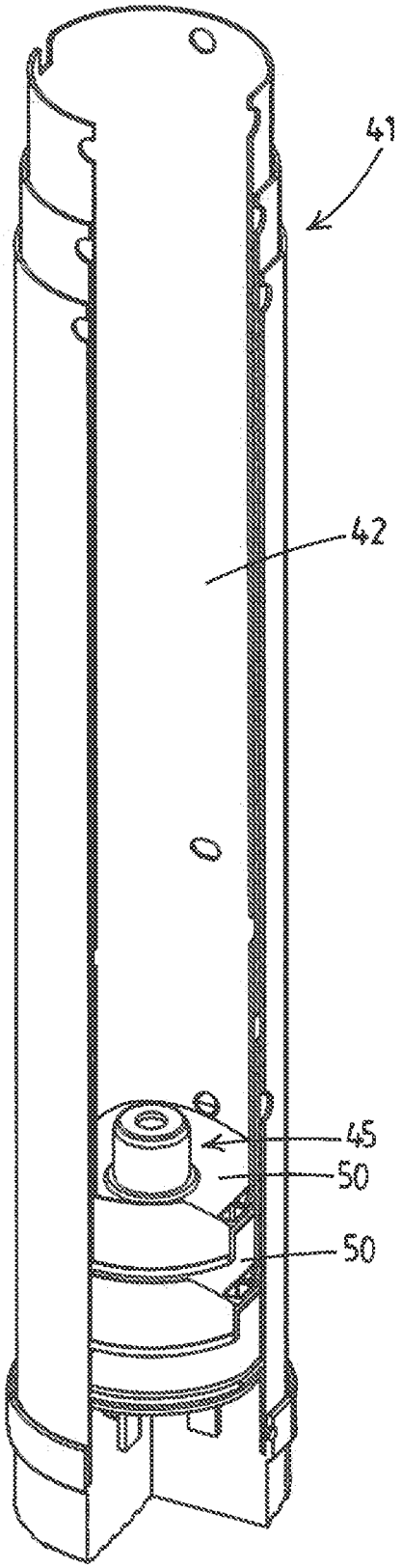

FIGS. 9*a* and *b* show the stile members with both the first and the second intermediate ladder section in the collapsed positon. In this position, the throttle valve of the air damper of the first stile member rests on the throttle valve securing device 4, which in the embodiment shown is provided in the form of the top housing of the air damper of the second stile member. The top housing member forms a table, having a throttle channel inlet/outlet opening at its center, that supports the throttle valve in its throttle position, and thus prevents it from buckling or moving in case of a raised air pressure in the stile member on which the air damper is mounted, i.e. the second stile member.

Furthermore, when the stile member with the air damper is in the collapsed position, the valve body of the throttle vale is held between the throttle opening of the air damper and the throttle channel inlet/outlet opening of the air damper comprising the housing member that functions as the second obturator member. Thus, the sealing properties of the valve member can be used to seal both openings, one on its top side and one on its bottom side.

In the embodiment shown the top housing members and the bottom housing members of the air dampers are configured to function as second obturator member and a first obturator member respectively. The top housing member and the bottom housing member are shaped like a cylinder and a cylindrical wall respectively, which cylinder and cylindrical wall are dimensioned such that, when a stile member is lowered into the collapsed position, the cylindrical wall falls like skirt over the cylinder of the lower air damper. The obturator members thus define a narrow gap between them, which allows for an efficient use of the throttle valve in providing an optimal sealing of the inner space of the stile member with the air damper from the inner space of the stile member in which the stile member with the air damper is received. The obturator device 49 is thus configured to provide additional throttling of the throttling opening of the air damper, and thus reduces air leakage via said throttle opening while the ladder section is in the collapsed position and receives the stile member of a collapsing ladder section.

According to the invention, the first obturator member is provided at the bottom end of the tubular stile member on which the air damper has been mounted, and a second obturator member is located at the bottom end of the stile member in which the stile member with the first obturator member is received when in the collapsed position. Thus, the obturator device is only active when the ladder section comprising the first obturator member is in the collapsed position, in which position the first obturator member is located adjacent the second obturator member and the first and second obturator members cooperate to form an additional seal and/or throttle opening for an air flow passing through the throttle opening of the air damper.

It is noted that the embodiment in which the housing members are configured to form a throttle channel is in particular beneficial when throttle valve is configured to be moved between the release position and the throttle position by air pressure, i.e. is a light type of valve e.g. a Boston type valve. The channel like configuration channels the air flowing through the throttle opening and thus promotes the air flow pushing the valve body into or out of the throttle opening.

Thus, in the preferred embodiment shown in FIGS. 7*a*-9*b*, the intermediate ladder sections are provided with a similar throttle valve, which throttle valves are located in line with each other. The throttle valves are provided with a top housing member, at a side that faces the inner space of the stile member on which the air damper is mounted, which housing member is configured to form the throttle valve securing device of the throttle valve mounted on the stile member that is telescopically received in the inner space of the stile member on which the air damper is mounted. In such an embodiment, when the ladder sections are all in the collapsed position, the air dampers are located one on top of the other, such that the housing of each lower air damper engages the throttle valve of the subsequent higher air damper.

The housing member that acts as the throttle valve securing device comprises a support surface for engaging the throttle valve of an air damper mounted in a stile member that is telescopically received in the stile member in which the air damper with the above mentioned housing is mounted, and the throttle outflow opening is located in the support surface such that the support surface extends around the throttle opening and such that, when the above mentioned housing engages the throttle valve of an air damper of a collapsed ladder section, the supported throttle valve seals the throttle outflow opening.

It is submitted that in the embodiment shown, the air damper body, the top housing member and the bottom housing member are separate bodies, which are combined during assembly, to facilitate the production process. Such n embodiment is in particular beneficial when the components are injection moulded. In an alternative embodiment the components may be integrated into a single; component or subdivided into more than three and/or alternative components.

In the embodiment shown in FIGS. 7*a*-9*b*, the bottom ladder section is provided with a second obturator member 49 and throttle valve securing device 48 combined in a cylindrical protrusion with a support surface. The protrusion is provided as part of a bottom cap inserted in the bottom end of the stile member of the bottom ladder section to in combination with the air damper of the second stile member provide a barrier and restrict air from flowing out of the second stile member when the second stile member is in the collapsed position and the first stile member moves into the second stile member.

In the embodiment shown, there is further more provided a one way air valve 54 that allows air to flow into the stile member of the bottom ladder section, when the ladder section with the second stile member is moved out of its collapsed position and into its extended position.

Figure 10:
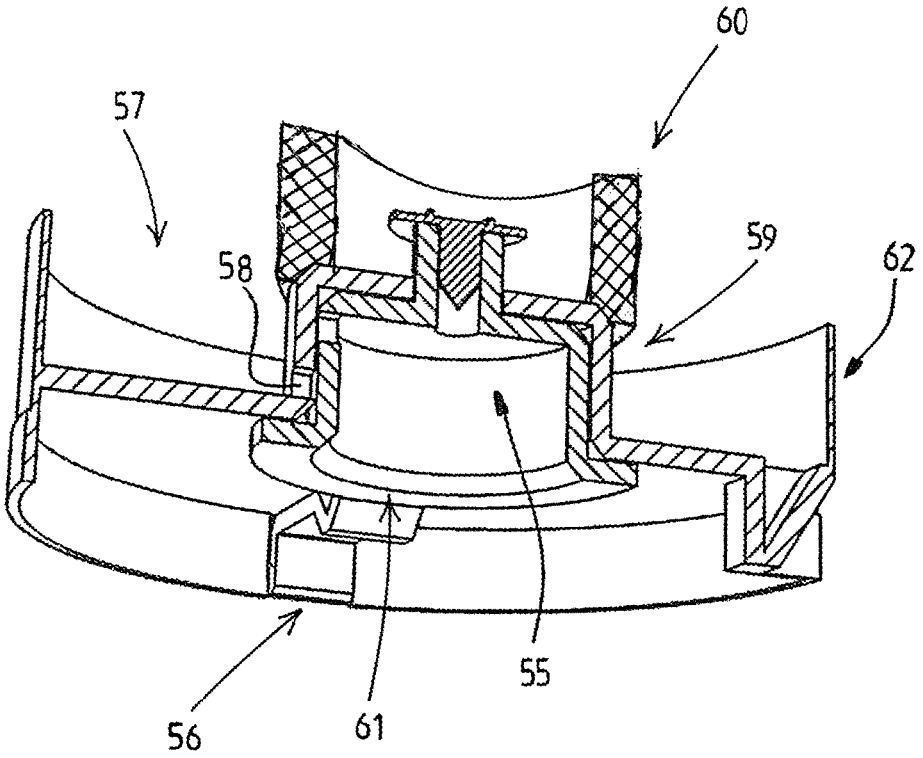

Show in FIG. 10 are a throttle valve 55 and an end cap 62, which end cap is part of an air damper 57 comprising said throttle valve 55. The throttle valve 55 is configured to be moved relative to a throttle opening 58 of the air damper 57 by frictional engagement of the inside surface of the tubular stile member of the adjacent ladder section. The throttle valve 55 is moveably supported and comprises multiple grip pads 56, which grip pads are each positioned adjacent the inside surface of the tubular stile member of the adjacent ladder section and make frictional contact with the inside surface. Thus, by moving the collapsible ladder section out of the extended position and into the collapsed position, due to the frictional contact the relative movement of the two stile members makes that the throttle valve is moved from the release position into the throttle position, and vice versa.

In the embodiment shown, the throttle valve securing device 60 is embodied as a support ring that is mounted on the valve housing. The support ring is provided to bridge the gap between the air dampers, and, in the embodiment shown, engages the throttle valve to support the throttle valve in its throttle position, more in particular to thus secure the throttle valve in its throttle position when the ladder sections are in their collapsed positon.

In the embodiment shown, the securing device is configured as a ring of flexible material, which ring has a top surface that, when the a ladder stile is fully inserted into the stile member with the air damper, engages the bottom 61 of the throttle valve of the air damper in the inserted ladder section, and thus prevents that throttle valve to move out of its throttle position.

In the embodiment shown, the ring is made of a flexible material and is dimensioned such that it is compressed when the securing device engages the throttle valve. Thus, the throttle valve is secured in its closed position under bias.

In an alternative embodiment, the throttle valve securing device can be embodied as a support that, in addition or as an alternative, engages the grip pads, and/or the radial arms connecting the grip pads with the valve body, to thus support the throttle valve in its throttle position.

It is submitted that, in an embodiment according to the invention, the air damper and the throttle valve securing device and/or the obturator device, are configured such that the air dampers are mounted one on top of the other, i.e. contact each other, to thus enable the air dampers to function as a throttle valve securing device and an obturator device. This in contrast with prior art air dampers, which are typically positioned at a distance from each other even when the ladder is in its collapsed condition.

Figure 14:
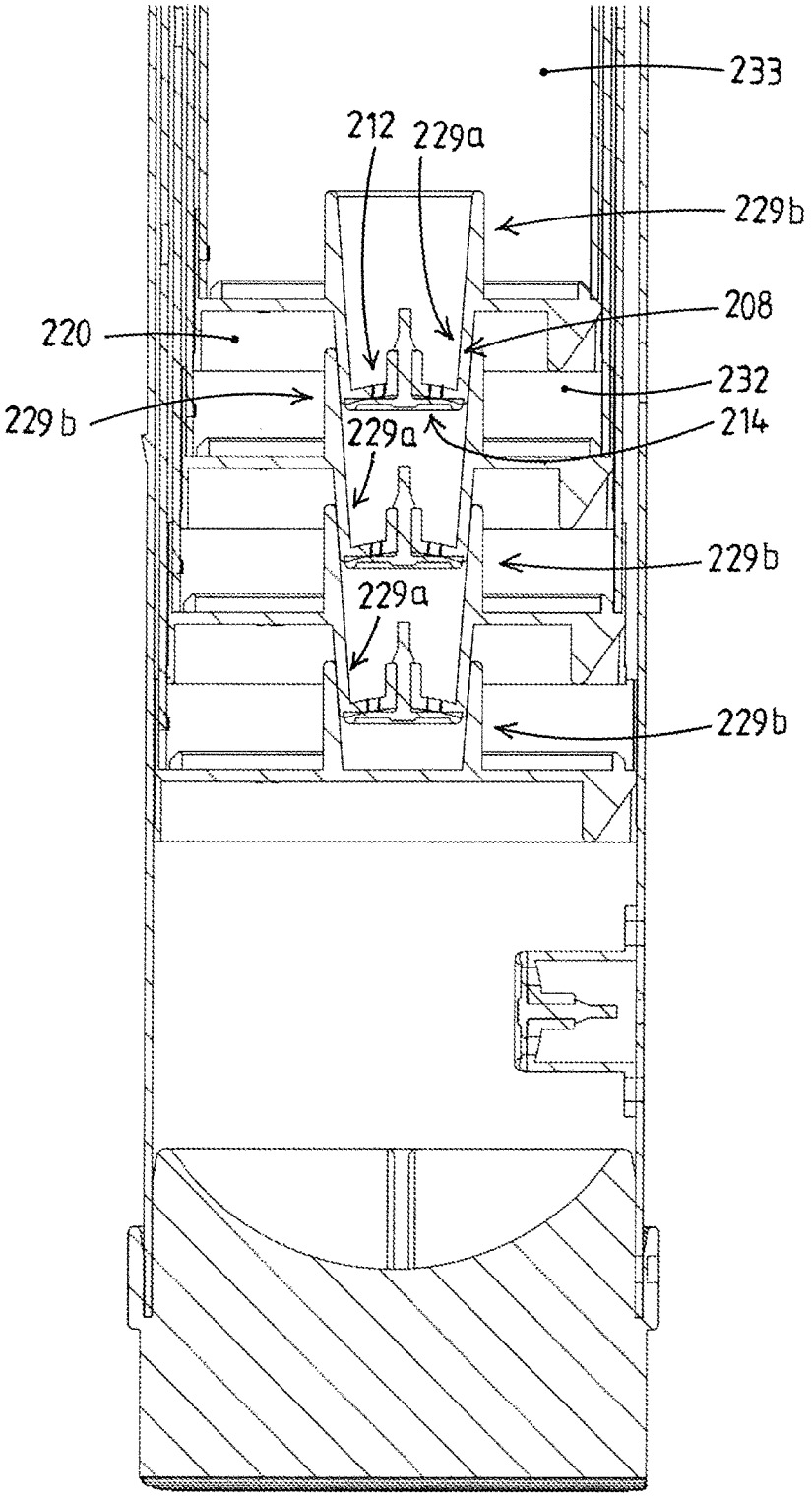
FIG. 14 shows a schematic side view in cross section of the four stile members of FIG. 12, with the stile members in a collapsed position, i.e. telescopically inserted into each other.

FIG. 14 shows a schematic side view in cross section of four stile members 111, 112, 113, 114, of three intermediate and one bottom ladder section. The stile members of the intermediate ladder sections 111, 112, 113 are provided with an air damper 115 in an end cap 116 located at the bottom end of the stile members. In the condition shown, the second and third stile member are in the inserted position. The first stile member 111 is moving into its inserted position, its air damper has the throttle valve moved in the throttle position.

The air dampers are provided with an obturator device 117. The end cap 116 comprises a first obturator member 118. A second obturator member 119 is located at a distance from the end cap 116.

Thus, in the embodiment shown, the second obturator member 119 is not located on an air damper body defining a throttle opening, but is fixed to the inside surface of the tubular stile member in which the air damper has been mounted.

In an alternative embodiment, the first obturator member is not located on the air damper body defining the throttle opening, but is fixed to the inside surface of the tubular stile member in which the air damper has been mounted.

Figure 11:
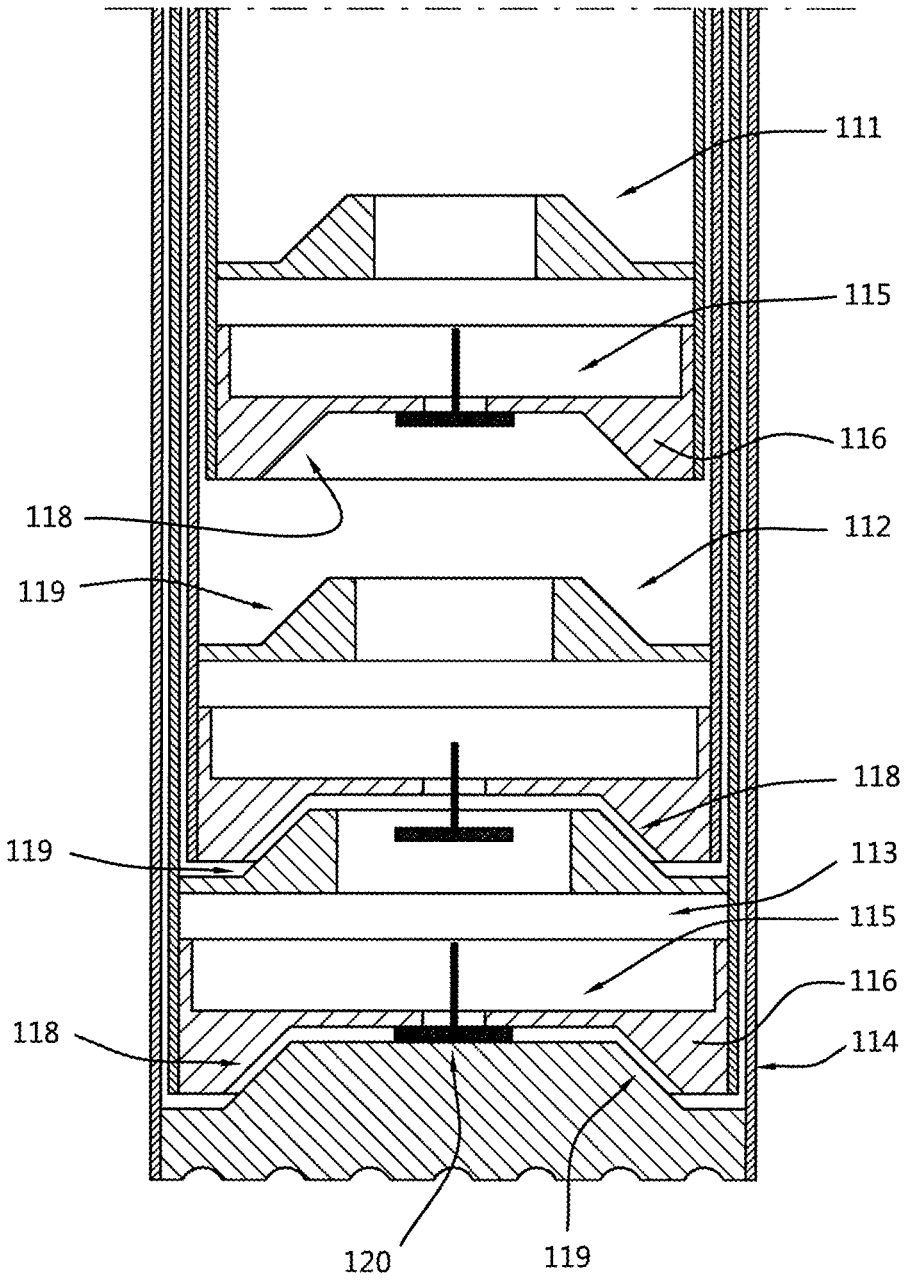
FIG. 11 shows a schematic side view in cross section of four stile members, of three intermediate and one bottom ladder section, wherein the stile members of the intermediate ladder sections are provided with a check valve in an end cap located at the bottom end of the stile members, wherein the end cap comprises a first obturator member, and with a second obturator member located at a distance from the end cap.

In the condition shown in FIG. 11, the obturator devices 117 of the second and third stile members 112, 113, which stile members are in the collapsed position, are in their active position and thus form an annular gap between the first and second obturator member, to thus throttle a flow of air passing through the throttle opening and through the gap between stile members.

In the embodiment shown, the stile member 114 of the bottom ladder section comprises an second obturator member 119, and, in contrast with the other obturator members, is not provided with a central opening but forms a throttle valve securing device 120. Since the ladder section of the third stile member is in its collapsed position, and the third stile member is in inserted position, the valve securing device and the obturator device are both in their active position, i.e. secure the throttle valve in its closed position and form a narrow gap respectively.

In a preferred embodiment according to the invention, each of the stile members is, in addition to the obturator device, provided with an air valve securing device according to the invention. Thus, the obturator device prevent, or at least reduce, air leakage through the annular gaps between the stile members, and the air valve securing devices, preferably in combination with a throttle valve, prevent, or at least reduce, air leakage through the throttle opening of the air damper.

Figure 12:
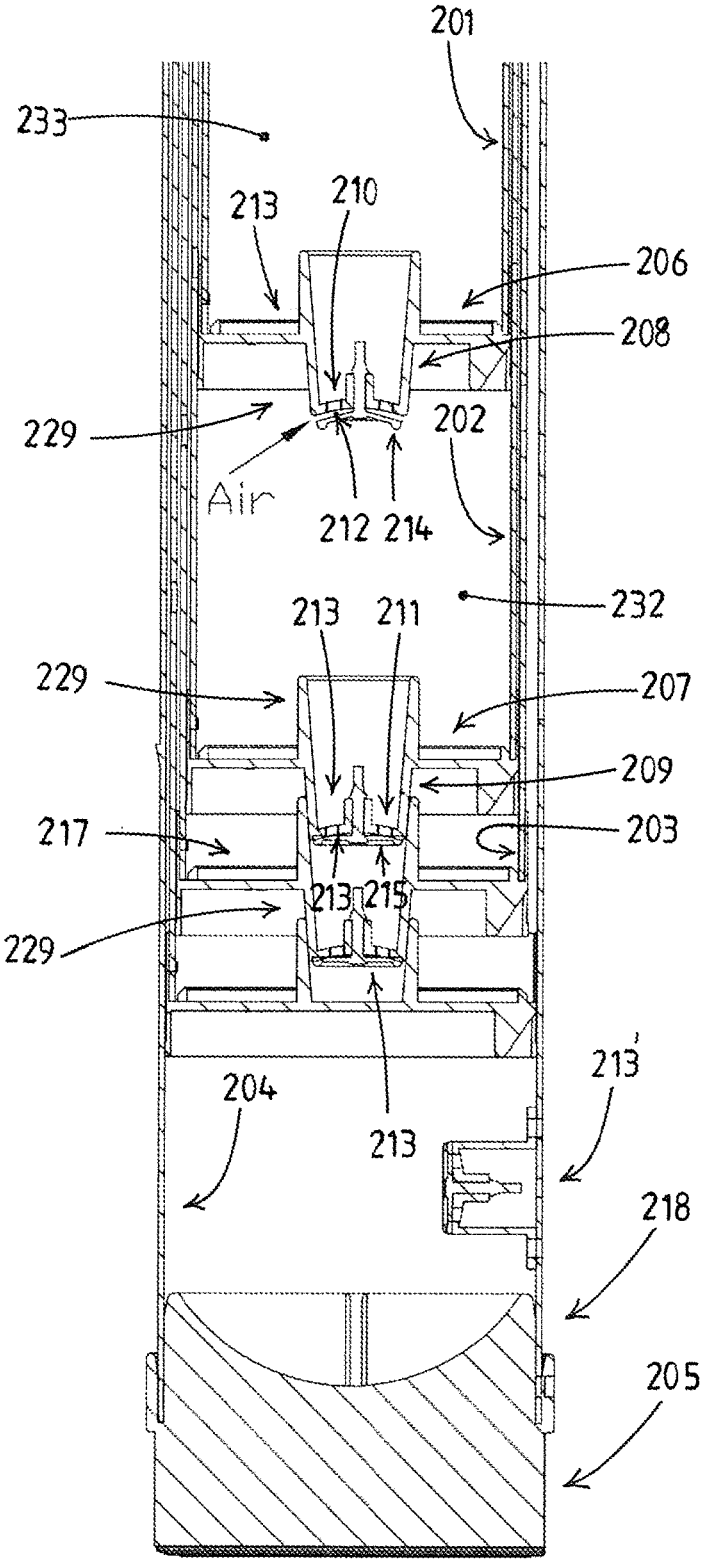
FIG. 12 shows a schematic side view in cross section of four stile members, of three intermediate and one bottom ladder section, wherein the stile members of the intermediate ladder sections are provided with an obturator device, while the first stile member is being moved into the second stile member.

FIG. 12 shows a schematic view in cross section a first stile member 201 having a bottom end 206 received in a second stile member 202, the second stile member having a bottom end 207 received in a third stile member 203, the third stile member having a bottom end 217 received in a fourth stile member 204. The fourth stile member 204 is part of a bottom ladder section, and is provided with a ground engaging foot member 205 (e.g. of rubber or the like).

Figure 13:
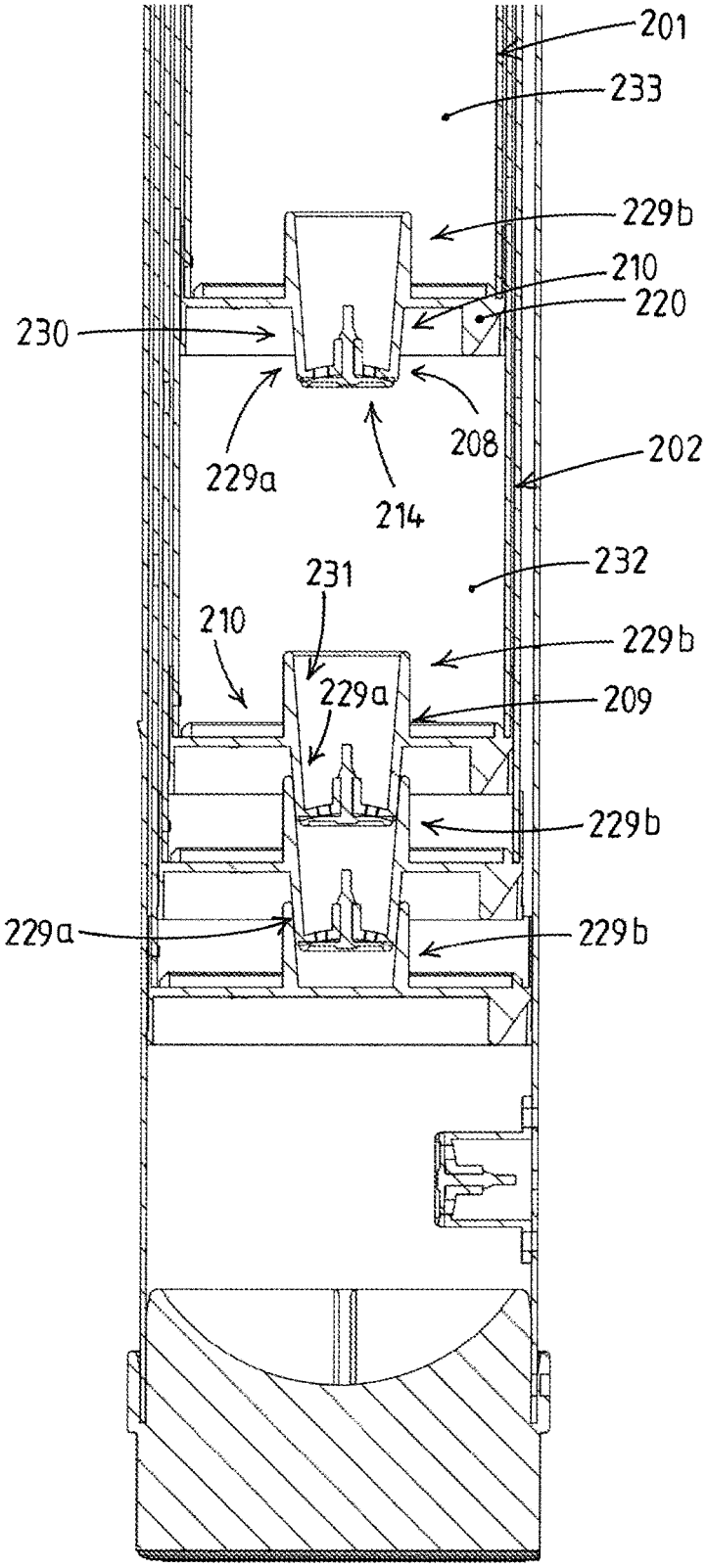
FIG. 13 shows a schematic side view in cross section of the four stile members of FIG. 12, while the first stile member is being moved out of the second stile member.

In FIGS. 12-14 the stile members 201-204 are part of a telescopic ladder similar to the one shown in FIG. 1, the telescopic ladder comprises further stile members which have not been depicted. It is furthermore noted that for explanatory reasons, the stile members in the FIGS. 12-14 have been partially depicted only. The figures do not show the top ends of the stile members, or other components of the ladder sections they are part of. These ladder sections are however similar to the ladder sections discussed above. The explanation below will mainly focus on the first stile member 201 and second stile member 202.

The first stile member 201 is received in the second stile member 202 in a semi extended position, i.e. between a fully inserted or collapsed position and a fully extended position. In the position shown, the bottom end 206 of the first stile member 201 is located away from the bottom end 207 of the second stile members 202. The second stile member 202 is telescopically received in a third stile member 203 in a collapsed position.

The stile members 201-204 are each provided with an air damper 213, be it that the configuration of the air damper 213' in the fourth stile member 204 differs from the configuration of the air dampers provided in the other stile members 201-203. The air dampers 213 all comprise an air damper body 210, 211, the air damper body defining multiple throttle openings 212, 213, and a throttle valve 214, 215. The air dampers 213 in the first, second and third stile member furthermore are provided with an obturator device 229 according to the present invention.

FIG. 12 shows the stile members 201-204, with the second and third stile members in the collapsed position, while the first stile member 201 is moving into the extended position, i.e. in the upward direction.

FIG. 13 shows the stile members 201-204, with the second and third stile members in the collapsed position, while the first stile member 201 is moving into the collapsed position, i.e. in the downward direction.

FIG. 14 shows the stile members 201-204 all in the collapsed position.

It should be noted that herein the intermediate ladder sections and the top ladder section of a ladder assembly are referred to as a collapsible ladder section when the particular ladder section is the ladder section that is moved, either from the extended position into the collapsed position or from collapsed position into the extended position.

Typically in this context, the focus is on the lower end of the tubular stile members of that collapsible ladder section, i.e. the part of the ladder section that is being received into or extended from the top ends of the adjacent ladder section.

The intermediate ladder sections and the bottom ladder section are referred to as an adjacent ladder section when the particular ladder section is the passive ladder section, i.e. is the ladder section into which the collapsible ladder section is inserted or from which the collapsible ladder section is extended.

Typically in this context, the focus is on the upper end of the tubular stile members of that adjacent ladder section, i.e. the part of the ladder section into which stile members of the collapsible ladder are telescopically received.

In the configuration shown in FIGS. 12-14, the first, second and third stile member 201-203 are all stile members of intermediate ladder sections. Because FIGS. 12 and 13 show the first stile member 201 being moved relative to the second stile member, in which it is telescopically received, here below the first stile member 201 is also referred to as the stile member of a collapsible ladder section while the second stile member 202 is referred to as the stile member of an adjacent ladder section.

As already set out above, in the embodiment of the collapsible telescopic ladder shown in FIGS. 12-14, the first stile member 201 is provided with air damper 208, which is located within the tubular stile member 201 at the bottom end 206 thereof, and which comprises the air damper body 210 defining the throttle opening 212. The throttle opening 212 provides an air path that enables air to flow out of the tubular stile member 202 of the adjacent ladder section into the tubular stile member 201 of the collapsible ladder section on which the air damper 208 is mounted and vice versa.

The air damper 208 furthermore has a throttle valve 214, which throttle valve is located at the throttle openings 212, at a side of the air damper 208 that faces the adjacent ladder section. The throttle valve 214 is supported such that it is movable relative to the throttle opening 212 between a release position, shown in FIG. 12, and a throttle position, shown in FIG. 13 and FIG. 14.

In the exemplary embodiment that is schematically shown in FIGS. 12-14, the throttle valve 214 is a check valve configured to be moved relative to the throttle opening 212 by the flow of air between the release position and the throttle position. In such an embodiment, the throttle valve is a relatively light valve that is resilient and/or movably supported such that the flow of air generated by the movement of the collapsible ladder section moves the valve into and/or out of the throttle position.

In the embodiment shown, the throttle valve 214 is Boston type of check valve configured to sealingly cover the throttle openings when in the throttle position. The throttle valve is made of a flexible material, e.g. a rubber, and is configured such that when the ladder section is in rest, see FIG. 14, and during the collapse of the ladder assembly, see FIG. 13, the throttle valve is biased into the throttle position, while during extension of the ladder assembly, see FIG. 12, a pressure difference bends the throttle valve into the release position.

In the release position the throttle valve 214 is located away from the throttle openings 212 to allow for a maximum air flow to flow through the throttle openings 212 out of the first stile member 201, on which the air damper 208 is mounted.

Thus, upon extending the collapsible ladder section comprising the stile member 201, the inner space 232 in the adjacent stile member 202, also referred to as the second stile member, located on lower side of the throttle valve 214, is increased, causing a drop in pressure in said inner space 232 compared to the pressure in the inner space 233 of the first stile member 200*a*, located on the opposite top side of the throttle valve 214. This pressure difference moves the throttle valve 214 resiliently away from the throttle opening and into the release position, shown in FIG. 12, in which it enables aerating the inner space 232 of the stile member 202 of the lower ladder section, out of which the stile member 201 of the collapsible ladder section is moved. Thus, the throttle valve prevents a substantial under pressure to develop in the inner space 232 of the second stile member 202, i.e. the lower adjacent ladder section, and thus facilitates moving the stile member 201 of the collapsible ladder section from the collapsed position, shown in FIG. 14, into the extended position.

In the throttle position, shown in FIG. 13, the throttle valve 214 is located adjacent to the throttle openings 212 to throttle, in the embodiment shown to block, an air flow flowing through the throttle openings and into the stile member 201 of the collapsible ladder section on which the air damper 208 is mounted. In this position, upon collapsing of the collapsible ladder section, the air damper 208 reduces the outflow options of air in the second stile member 202 and thus enables a pressure to build up in the inner space 232 of that stile member 202 when the stile member 201 of the collapsible ladder section is moved into the inner space 232 of that stile member. This pressure build up provides the retardation of the gravity induced velocity of the collapsible ladder sections during collapse of the collapsible ladder section.

In the embodiment shown in FIGS. 12-14, the air dampers 214 are provided with an obturator device 229. The obturator devices 229 each comprise a first obturator member 229*a* and a second obturator member 229*b*.

The first obturator members 229*a* are each provided at the bottom end of the tubular stile member of the collapsible ladder section on which the particular air damper is mounted. The first obturator member 229*a* is located at a side of the air damper that faces the adjacent ladder section.

The second obturator member 229*b* is located at the bottom end of the tubular stile member of the adjacent ladder section, i.e. the ladder section in which the stile member with the first obturator member is received when in the collapsed position.

According to the present invention, the first obturator member and the second obturator member are configured to, when the collapsible ladder section is in the collapsed position, in combination provide additional throttling, in the particular embodiment shown a blockage, of an air flow flowing through the throttle opening out of the stile member on which the air damper and the first obturator member are mounted.

In the particular embodiment shown in FIGS. 12-14, an end cap 220, which also forms the air damper body 226, comprises the first obturator member 229*a*. Thus, the first obturator member 229*a* is located at the bottom end 206 of the tubular stile member 201 of the collapsible ladder section on which the air damper 208 has been mounted.

The first obturator member 229*a* is provided in the form of a conical shaped obturator surface 230 located at the bottom side of the air damper body 210, and is thus located at a side of the air damper 208 that faces the stile member 202 of the adjacent ladder section.

Furthermore, in the exemplary embodiment shown, the first obturator member 229*a* is an integrated component of the air damper body 210 defining the throttle opening 212.

The second obturator member 229*b* of the air damper 208 of the first stile member 201 is provided in the form of a corresponding obturator surface 231, in the embodiment shown a conical shaped surface complementary to the conical shaped surface of the first obturator member 229*a*, which corresponding obturator surface 231 is located on the air damper body 210 of the air damper 209 provided in the second stile member 202 of the adjacent ladder section, also referred to as the lower ladder section.

Thus, the second obturator member 229*b* is located at the bottom end 207 of the tubular stile member 202 of the adjacent ladder section, i.e. the ladder section in which the stile member 201 with the first obturator member 229*a* is received when in the collapsed position.

In the exemplary embodiment shown, the second obturator member 229*b* is an integrated component of the air damper body 211 provided in the second stile member. The second obturator member 229*b* is located at the side of the air damper that faces the stile member 201 of the collapsible ladder section.

The first obturator member 229*a* and the second obturator member 229*b* are configured to, when the collapsible ladder section 201 is in the collapsed position, in combination block an air flow flowing through the throttle opening 212 out of the stile member 201 on which the air damper 208 is mounted.

Thus, when the collapsible ladder section is in the extended position, the obturator members are located away from each other and do not influence the flow of air through the throttle opening. When the collapsible ladder section is in the collapsed position, shown in FIG. 14, the obturator surfaces 230, 231 are positioned parallel to each other and contact each other such that they block any air from flowing via the throttle openings 212.

It has been found that throttling, or even blocking, an air flow flowing out of the stile members of the collapsed ladder section, when the ladder section is in the collapsed position, allows for a better controlled collapsing behaviour. By providing a throttle valve securing device and/or an obturator device, air leakage from the tubular stile member while receiving a collapsing ladder section is reduced, this enables a more equal time for each ladder section to slide from its extended position into its collapsed position. thus, there is less variance in the time it takes for each ladder section tom move from the extended into the collapsed position, compared to prior art collapsible ladders.

As was explained above, when the stile members are in the collapsed position, the obturator devices are in their active position. In this active position, the first obturator member and the second obturator member of the respective obturator device contact each other, to thus prevent a flow of air from passing through the throttle opening and out of one stile member into the other stile member. Thus, the obturator device enables a pressure build up in the inner space of the tubular stile member provided with the throttle valve with the first obturator member, when a stile member of a collapsing ladder section is inserted into that inner space.

In the condition shown in FIG. 214, with the first stile member of a collapsible ladder section in the collapsed position, i.e. the first stile member being fully inserted into the adjacent second stile member, the obturator surfaces 230,231 of the first and second obturator members extend around the throttle opening 227 and contact each other, such that the first obturator member and the second obturator member in combination form an annular barrier, which barrier is located between the throttle opening and the inner space of the second tubular stile member in which the first stile member with the air damper is received. Thus, in this position the obturator device prevents air from flowing from the inner space of the first stile member into the inner space of the second stile member, and thus allows for a pressure increase in the inner space of the first stile member when another stile member is telescopically inserted into that space. This increase in pressure will dampen the speed with which that other stile member is moving into the inner space of the first stile member.

In the particular embodiment shown in FIGS. 12-14, the air dampers provided in the first, second and third stile members comprise both a first obturator member, for in an active position blocking air from flowing through the throttle openings of the respective air damper comprising the first obturator member, and a second obturator member, for in an active position blocking air from flowing through the throttle openings of an air damper on a stile member inserted in the stile member of the respective air damper comprising the second obturator member.

In the particular embodiment shown, the fourth stile member 204 is part of a bottom ladder section. In contrast with the other stile members, the fourth stile member comprises only a second obturator member 229*b*, for cooperating with a first obturator member 229*a* of the obturator device 229 associated with the throttle valve provided in the third stile member 203. The fourth stile member does not comprise a first obturator member.

Furthermore, in the particular embodiment shown, in contrast with the other stile members, the second obturator member 229*b* and the throttle valve 216 mounted in the fourth stile member are separate components. Also, in the particular embodiment shown, the throttle vale 216 is provided in an opening in the side wall of the fourth stile member 204.

In a further embodiment according to the invention, each of the throttle valves is, in addition to the obturator device, provided with an air valve securing device according to the invention. In such an embodiment, for each throttle valve, the obturator device prevents air flowing out of the inner space of the stile member provided with the respective throttle valve, when said stile member is in the collapsed position. In addition, for each throttle valve, the air valve securing device prevents, or at least reduces, air flowing out of the inner space of the stile member provided with the respective throttle valve, when said stile member is in the collapsed position.

REFERENCE SIGNS

01 telescopic ladder
02 bottom ladder section
03 top ladder section
04 intermediate ladder section
04' adjacent ladder section
05 tubular stile member

05*a* bottom end tubular stile member
05*b* top end tubular stile member
06 tubular stile member
06*a* bottom end tubular stile member
06*b* top end tubular stile member
07 ladder rung
08 bottom ladder rung
09 air damper
10 actuators for unlocking the tubular stile members
11 first stile member
11*a* bottom end first stile member
11*b* top end first stile member
12 second stile member
12*a* bottom end second stile member
12*b* top end second stile member
13 air damper
14 throttle valve
15 throttle valve securing device
16 air damper body
17 throttle opening
18 throttle valve
19 end cap
20 valve body
21 first stile member
21*a* bottom end first stile member
21*b* top end first stile member
22 second stile member
22*a* bottom end second stile member
22*b* top end second stile member
23 air damper
24 throttle valve
25 securing device
26 air damper body
27 throttle opening
28 throttle valve
29 throttle valve securing device
29*a* first obturator member
29*b* second obturator member
30 obturator surface first obturator member
31 obturator surface second obturator member
32 inner space of the second stile member
33 inner space of the first stile member
41 ladder assembly
42 first stile member
43 second stile member
44 third stile member
45 air damper
46 throttle opening
47 throttle valve
48 Throttle valve securing device
49 obturator device
49*a* first obturator member
49*b* second obturator member
50 cap
51 Top housing member
52 Bottom housing member
53 throttle channel
54 one way air valve bottom ladder section
55 throttle valve moved by friction
56 friction pad
57 air damper
58 throttle opening
59 housing air damper
60 support ring
61 bottom throttle valve
62 end cap
63 throttle valve securing device bottom ladder section
111 first stile member
112 second stile member
113 third stile member
114 fourth stile member
115 air damper
116 end cap
117 obturator device
118 first obturator member
119 second obturator member
120 throttle valve securing device
201 1st stile member
202 2nd stile member
203 3rd stile member
204 4th stile member
205 foot member 4th stile member
206 bottom end 1st tubular stile member
207 bottom end 2nd stile member
208 air damper in 1st stile member
209 air damper in 2nd stile member
210 air damper body in 1st stile member
211 air damper body in 2nd stile member
212 throttle openings in 1st stile member
213 throttle openings in 2nd stile member
214 throttle valve in 1st stile member
215 throttle valve in 2nd stile member
216 throttle valve in 5th stile member
217 bottom end 3rd stile member
218 bottom end 4th stile member
220 end cap
221 valve body
226 air damper body
228 throttle valve securing device
229 obturator device
229*a* First obturator member
229*b* Second obturator member
230 obturator surface
231 corresponding obturator surface
232 inner space 2nd stile member
233 inner space 1st stile member
249 obturator device

The invention claimed is:

1. A telescopically extendable and collapsible ladder assembly having a bottom ladder section, a top ladder section, and one or more intermediate ladder sections, wherein each of the ladder sections comprises two tubular stile members, each tubular stile member having a bottom end and a top end and each tubular stile member defining an inner space, which tubular stile members are arranged parallel to each other and are interconnected at the top end by a ladder rung to form a U-shaped ladder section, wherein the tubular stile members of the bottom ladder section are furthermore connected by a bottom ladder rung, wherein the top ladder section and the one or more intermediate ladder sections are collapsible ladder sections, each collapsible ladder section having the bottom end of the tubular stile members telescopically inserted into the top end of the tubular stile members of an adjacent ladder section, the adjacent ladder section being the bottom ladder section or an intermediate ladder section, such that each collapsible ladder section can be moved relative to the adjacent ladder section between;

a collapsed position, in which the bottom end of the tubular stile members of the collapsible ladder section are located near the bottom end of the tubular stile members of the adjacent ladder section; and an extended position, in which the bottom end of the tubular stile members of the collapsible ladder section are located away from the bottom end of the tubular stile members of the adjacent ladder section;

wherein the ladder assembly comprises latch mechanisms for locking the telescopically inserted tubular stile members of the collapsible ladder sections relative to the adjacent ladder sections when the collapsible ladder section are in the extended position, the latch mechanisms being associated with actuators for unlocking the tubular stile members in order to allow for collapsing of the ladder assembly, and moving all collapsible ladder sections into the collapsed position, wherein the collapsible ladder sections are each provided with an air damper at the bottom end of at least one of the tubular stile members, which air dampers provide retardation of gravity induced velocity of the collapsible ladder sections upon collapse of the ladder sections on the basis of throttling an airflow flowing out of the inner space of the tubular stile member of the adjacent ladder section into the inner space of the tubular stile member of the collapsible ladder section being inserted into the inner space of the tubular stile member of the adjacent ladder section, wherein each of the air dampers comprises:

an air damper body defining a throttle opening, which throttle opening provides an air path that enables air to flow out of the tubular stile member of the adjacent ladder section into the tubular stile member of the collapsible ladder section on which the air damper is mounted and vice versa;

a throttle valve, which throttle valve is located at the throttle opening, and which throttle valve is movable relative to the throttle opening between:

a release position, in which release position the throttle valve is located away from the throttle opening to allow for a maximum air flow to flow through the throttle opening out of the stile member on which the air damper is mounted, and thus, upon extending the ladder section, to enable aerating of the inner space of the stile member of the adjacent ladder section out of which the collapsing ladder section is moved; and a throttle position, in which throttle position the throttle valve is located adjacent to or in the throttle opening to throttle or block an air flow flowing through the throttle opening into the stile member of the collapsible ladder section on which the air damper is mounted, and thus, upon collapsing of the collapsible ladder section, enabling a pressure build up in the inner space of the stile member of the adjacent ladder section into which the collapsible ladder section is being inserted;

wherein the ladder assembly further comprises:

a throttle valve securing device, located at the bottom end of the adjacent ladder section, for cooperating with the throttle valve of the air damper when the collapsible ladder section is in the collapsed position, to secure the throttle valve in its throttle position and to thus enable the throttle valve to throttle or block, an air flow flowing through the throttle opening out of the tubular stile member on which the air damper is mounted, and thus, allow for a pressure build up in the inner space of the tubular stile member on which the air damper is mounted when a stile member of a collapsing ladder section is inserted in the inner space of that stile member.

2. The ladder assembly according to claim 1, wherein the ladder assembly further comprises: an obturator device, the obturator device comprising:

a first obturator member at the bottom end of the tubular stile member of the collapsible ladder section on which the air damper has been mounted, which first obturator member is located at a side of the air damper that faces the adjacent ladder section, and a second obturator member located at the bottom end of the tubular stile member of the adjacent ladder section, being the ladder section in which the stile member with the first obturator member is received when in the collapsed position, wherein the first obturator member and the second obturator member are configured to, when the collapsible ladder section is in the collapsed position, in combination provide additional throttling, or a blockage, of an air flow flowing through the throttle opening out of the stile member on which the air damper and the first obturator member are mounted.

3. The ladder assembly according to claim 1, wherein the throttle valve is a check valve configured to be moved into and/or out of the throttle position by the flow of air passing through the throttle opening and the throttle valve is a relatively light valve that is resilient or movably supported such that the flow of air generated by the movement of the collapsible ladder section moves the valve into or out of the throttle position.

4. The ladder assembly according to claim 1, wherein the throttle valve is a check valve configured to be moved relative to the throttle opening by frictional engagement of the inside surface of the tubular stile member of the adjacent ladder section, and the throttle valve is moveably supported and comprises one or more grip pads, which grip pads are each positioned adjacent the inside surface of the tubular stile member of the adjacent ladder section and make frictional contact with the inside surface, such that by moving the collapsible ladder section out of the extended position and into the collapsed position the throttle valve is moved from the release position into the throttle position, and vice versa.

5. The ladder assembly according to claim 2, wherein the first obturator member is a flexible sealing body located on either the air damper body of the air damper with the throttle opening to be throttled or sealed by the obturator, or on a cap or an air damper body of an air damper that is located in the adjacent ladder section, wherein the second obturator member is a corresponding contact surface configured for engaging the first obturator member, and located on either the cap or the air damper body of the air damper that is located in the adjacent ladder section or on the air damper body respectively, and wherein the flexible sealing body and the corresponding contact surface are configured such that, when the collapsible ladder section is in the collapsed position and is received in the adjacent ladder section, the flexible sealing body and the corresponding contact surface either define one or more tight gaps between them that allow for a minimal air flow via the throttle opening or sealingly engage each other such that an air flow is blocked.

6. The ladder assembly according to claim 2, wherein the obturator device comprises an obturator surface located on the air damper body and a corresponding obturator surface located on a sealing cap or air damper body mounted in an adjacent ladder section, which obturator surfaces, when the collapsible ladder section is in the collapsed position, are positioned parallel to each other and adjacent to each other such that they define one or more tight gaps between them to allow for a minimal air flow via the throttle opening.

7. The ladder assembly according to claim 6, wherein the obturator surfaces extend substantially parallel to a longitudinal axis of the stile members.

8. The ladder assembly according to claim 1, wherein the air damper body is configured as a cap that is mounted in the bottom end of a stile member.

9. The ladder assembly according to claim 1, wherein the air damper comprises a housing, the housing comprising a top housing member at one side of the air damper body and a bottom housing member at an opposite side of the air damper body, which housing forms a throttle channel comprising the throttle opening.

10. The ladder assembly according to claim 9, wherein the housing of the air damper forms the throttle valve securing device.

11. The ladder assembly according to claim 1, wherein the air damper body of the air damper forms the throttle valve securing device.

12. The ladder assembly according to claim 2, wherein the air damper body of the air damper forms the first or second obturator member.

13. The ladder assembly according to claim 2, wherein the throttle valve securing device is configured as a body providing a support surface for engaging a throttle valve and provided with a circumferential side surface that functions as a first obturator member.

14. The ladder assembly according to claim 2, wherein the first obturator member is in the form of a skirt, the skirt comprising an annular wall having an inside circumferential surface, and the second obturator member is in the form of a cylindrical body comprising a circumferential outer wall having an outside circumferential surface, and wherein, in a working position, the skirt is lowered over the cylindrical body such that the inside circumferential surface of the skirt and the outside circumferential surface of the cylindrical body are located adjacent to each other and either contact each other or define a narrow gap to block or throttle a flow of air.

15. A stepladder having a first stepladder assembly and a second stepladder assembly hinged to one another so as to be in a storage position folded against one another and an operative position similar to an inverted V, one or both of the stepladder assemblies being a ladder assembly according to claim 1.

16. A work platform including a ladder assembly according to claim 1.

17. A method for collapsing a collapsible ladder assembly according to claim 1, wherein the method comprises:

using the actuators for unlocking the tubular stile members of a first collapsible ladder section in order to allow for collapsing of the ladder assembly;

moving the first collapsible ladder section towards its collapsed position, and thus moving the throttle valve into the throttle position to retard the gravity induced speed of the collapsing first collapsible ladder section;

moving the first collapsible ladder section into its collapsed position, and thus securing the throttle valve in its throttle position using the throttle valve securing device, wherein the throttle valve securing device is provided in the bottom ladder section of the ladder assembly;

using the actuators for unlocking the tubular stile members of a second collapsible ladder section in order to allow for collapsing of the ladder assembly;

moving the second collapsible ladder section towards its collapsed position, and thus moving the throttle valve into the throttle position to retard the gravity induced speed of the collapsing second collapsible ladder section; and moving the second collapsible ladder section into its collapsed position, and thus securing the throttle valve in its throttle position using the throttle valve securing device, wherein the throttle valve securing device is provided in the first ladder section of the ladder assembly.

18. A method for collapsing a collapsible ladder assembly according to claim 2, wherein the method comprises:

using the actuators for unlocking the tubular stile members of a first collapsible ladder section in order to allow for collapsing of the ladder assembly;

moving the first collapsible ladder section towards its collapsed position, and thus moving the throttle valve into the throttle position to retard the gravity induced speed of the collapsing first collapsible ladder section;

moving the first collapsible ladder section into its collapsed position, and thus securing the throttle valve in its throttle position using the throttle valve securing device and use the obturator device to provide additional throttling, or a blockage, of an air flow flowing through the throttle opening out of the stile member of the first collapsible ladder section, wherein the throttle valve securing device and second obturator member of the obturator device are provided in the bottom ladder section of the ladder assembly;

using the actuators for unlocking the tubular stile members of a second collapsible ladder section in order to allow for collapsing of the ladder assembly;

moving the second collapsible ladder section towards its collapsed position, and thus moving the throttle valve into the throttle position to retard the gravity induced speed of the collapsing second collapsible ladder section;

moving the second collapsible ladder section into its collapsed position, and thus securing the throttle valve in its throttle position using the throttle valve securing device and use the obturator device to provide additional throttling, of an air flow flowing through the throttle opening out of the stile member of the second collapsible ladder section, wherein the throttle valve securing device and second obturator member of the obturator device are provided in the first ladder section of the ladder assembly.

19. The ladder assembly according to claim 2, wherein the air damper comprises a housing, the housing comprising a top housing member at one side of the air damper body and a bottom housing member at an opposite side of the air damper body, which housing forms a throttle channel comprising the throttle opening, and wherein the air damper body of the air damper forms the first or second obturator member.

20. A telescopically extendable and collapsible ladder assembly having a bottom ladder section, a top ladder section, and one or more intermediate ladder sections, wherein each of the ladder sections comprises two tubular stile members, each tubular stile member having a bottom end and a top end and each tubular stile member defining an inner space, which tubular stile members are arranged parallel to each other and are interconnected at the top end by a ladder rung to form a U-shaped ladder section, wherein the tubular stile members of the bottom ladder section are furthermore connected by a bottom ladder rung, wherein the top ladder section and the one or more intermediate ladder sections are collapsible ladder sections, each collapsible ladder section having the bottom end of the tubular stile members telescopically inserted into the top end of the tubular stile members of an adjacent ladder section, the adjacent ladder section being the bottom ladder section or an intermediate ladder section, such that each collapsible ladder section can be moved relative to the adjacent ladder section between;

a collapsed position, in which the bottom end of the tubular stile members of the collapsible ladder section are located near the bottom end of the tubular stile members of the adjacent ladder section; and an extended position, in which the bottom end of the tubular stile members of the collapsible ladder section are located away from the bottom end of the tubular stile members of the adjacent ladder section;

wherein the ladder assembly comprises latch mechanisms for locking the telescopically inserted tubular stile members of the collapsible ladder sections relative to the adjacent ladder sections when the collapsible ladder section are in the extended position, the latch mechanisms being associated with actuators for unlocking the tubular stile members in order to allow for collapsing of the ladder assembly, and moving all collapsible ladder sections into the collapsed position, wherein the collapsible ladder sections are each provided with an air damper at the bottom end of at least one of the tubular stile members, which air dampers provide retardation of gravity induced velocity of the collapsible ladder sections upon collapse of the ladder sections on the basis of throttling an airflow flowing out of the inner space of the tubular stile member of the adjacent ladder section into the inner space of the tubular stile member of the collapsible ladder section being inserted into the inner space of the tubular stile member of the adjacent ladder section, wherein each of the air dampers comprises:

an air damper body defining a throttle opening, which throttle opening provides an air path that enables air to flow out of the tubular stile member of the adjacent ladder section into the tubular stile member of the collapsible ladder section on which the air damper is mounted and vice versa;

a throttle valve, which throttle valve is located at the throttle opening, and which throttle valve is movable relative to the throttle opening between:

a release position, in which release position the throttle valve is located away from the throttle opening to allow for a maximum air flow to flow through the throttle opening out of the stile member on which the air damper is mounted, and thus, upon extending the ladder section, to enable aerating of the inner space of the stile member of the adjacent ladder section out of which the collapsing ladder section is moved; and a throttle position, in which throttle position the throttle valve is located adjacent to or in the throttle opening to throttle or block an air flow flowing through the throttle opening into the stile member of the collapsible ladder section on which the air damper is mounted, and thus, upon collapsing of the collapsible ladder section, enabling a pressure build up in the inner space of the stile member of the adjacent ladder section into which the collapsible ladder section is being inserted;

wherein the ladder assembly further comprises an obturator device, the obturator device comprising:

a first obturator member at the bottom end of the tubular stile member of the collapsible ladder section on which the air damper has been mounted, which first obturator member is located at a side of the air damper that faces the adjacent ladder section, and a second obturator member located at the bottom end of the tubular stile member of the adjacent ladder section, being the ladder section in which the stile member with the first obturator member is received when in the collapsed position, wherein the first obturator member and the second obturator member are configured to, when the collapsible ladder section is in the collapsed position, in combination provide additional throttling, or a blockage, of an air flow flowing through the throttle opening out of the stile member on which the air damper and the first obturator member are mounted.

* * * * *